US007373983B2

(12) United States Patent
McGavern, III et al.

(10) Patent No.: US 7,373,983 B2
(45) Date of Patent: May 20, 2008

(54) DOWNHOLE MILLING MACHINE AND METHOD OF USE

(75) Inventors: Cecil G. McGavern, III, Kingwood, TX (US); Adrian V. Saran, Kingwood, TX (US); Winfield M. Sides, III, Bellaire, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

(21) Appl. No.: 11/685,595

(22) Filed: Mar. 13, 2007

(65) Prior Publication Data

US 2007/0181305 A1 Aug. 9, 2007

Related U.S. Application Data

(62) Division of application No. 10/407,391, filed on Apr. 4, 2003, now Pat. No. 7,188,674.

(60) Provisional application No. 60/408,366, filed on Sep. 5, 2002.

(51) Int. Cl.
*E21B 29/00* (2006.01)

(52) U.S. Cl. ..... 166/296; 166/55.7

(58) Field of Classification Search ..... 166/298, 166/55, 55.6, 55.7

See application file for complete search history.

(56) References Cited

U.S. PATENT DOCUMENTS

| | | | |
|---|---|---|---|
| 1,358,818 | A | 11/1920 | Bering |
| 2,280,769 | A | 4/1942 | Page |
| 2,500,785 | A | 3/1950 | Arutunoff |
| 2,539,047 | A | 1/1951 | Arutunoff |
| 3,059,708 | A | 10/1962 | Cannon et al. |
| 3,145,790 | A | 8/1964 | Bridwell et al. |
| 3,195,636 | A | 7/1965 | Cordary et al. |
| 3,331,439 | A | 7/1967 | Sanford |
| 3,528,515 | A | 9/1970 | Garrison |
| 3,696,868 | A | 10/1972 | Taylor, Jr. |
| 3,786,865 | A | 1/1974 | Tausch et al. |

(Continued)

FOREIGN PATENT DOCUMENTS

| | | |
|---|---|---|
| EP | 0 266 864 | 5/1998 |

(Continued)

OTHER PUBLICATIONS

GB Search Report, GB Application No. GB 0320906.1, dated Dec. 8, 2003.

*Primary Examiner*—Hoang Dang
(74) *Attorney, Agent, or Firm*—Patterson & Sheridan, L.L.P.

(57) ABSTRACT

The present invention is directed to a method and apparatus for providing a pathway for fluid communication through a tubing-retrievable subsurface safety valve (TRSSV). The method and apparatus are designed to be deployed within a hydrocarbon wellbore after the TRSSV has failed. The apparatus is a milling tool that is run into the wellbore and landed within the TRSSV. The milling tool comprises a housing system, a cutting system, a drive system, and an actuating system. In operation, the milling tool is landed within the housing of the TRSSV. Thereafter, the actuating system is initiated. The actuating system actuates the drive system, which in turn drives the cutting system. In one arrangement, the cutting system includes blades for shaving the pressure containing body of the TRSSV, thereby forming a pathway for fluid communication between a hydraulic fluid line and a bore of the safety valve.

20 Claims, 24 Drawing Sheets

U.S. PATENT DOCUMENTS

| | | | |
|---|---|---|---|
| 3,786,866 | A | 1/1974 | Tausch et al. |
| 3,799,258 | A | 3/1974 | Tausch |
| 3,859,877 | A | 1/1975 | Sherer et al. |
| 3,911,707 | A | 10/1975 | Minakov et al. |
| 4,125,013 | A | 11/1978 | Nicolas et al. |
| 4,550,781 | A | 11/1985 | Kagler, Jr. |
| 4,574,889 | A | 3/1986 | Pringle |
| 4,577,694 | A | 3/1986 | Brakhage, Jr. |
| 4,842,082 | A | 6/1989 | Springer |
| 4,944,351 | A | 7/1990 | Eriksen et al. |
| 4,955,951 | A | 9/1990 | Nemoto et al. |
| 4,981,177 | A | 1/1991 | Carmody et al. |
| 5,129,322 | A | 7/1992 | Christopher et al. |
| 5,180,012 | A | 1/1993 | Crawford |
| 5,201,817 | A | 4/1993 | Hailey |
| 5,249,630 | A | 10/1993 | Meaders et al. |
| 5,253,714 | A | 10/1993 | Davis et al. |
| 5,496,044 | A | 3/1996 | Beall et al. |
| 5,598,864 | A | 2/1997 | Johnston et al. |
| 5,687,806 | A | 11/1997 | Sallwasser et al. |
| 5,799,949 | A | 9/1998 | Beall et al. |
| 5,899,268 | A | 5/1999 | Lynde et al. |
| 6,059,041 | A | 5/2000 | Scott |
| 6,352,118 | B1 | 3/2002 | Dickson et al. |
| 6,523,614 | B2 | 2/2003 | Dennistoun et al. |
| 6,868,901 | B2 | 3/2005 | Mason et al. |
| 6,880,641 | B2 | 4/2005 | Dennistoun et al. |
| 6,953,093 | B2 | 10/2005 | Dennistoun et al. |
| 6,991,040 | B2 | 1/2006 | Hill, Jr. et al. |
| 2002/0150436 | A1 | 10/2002 | Mason et al. |

FOREIGN PATENT DOCUMENTS

| | | |
|---|---|---|
| EP | 1 241 321 | 9/2002 |
| GB | 2 352 747 | 2/2001 |
| WO | WO 02/086282 | 10/2002 |

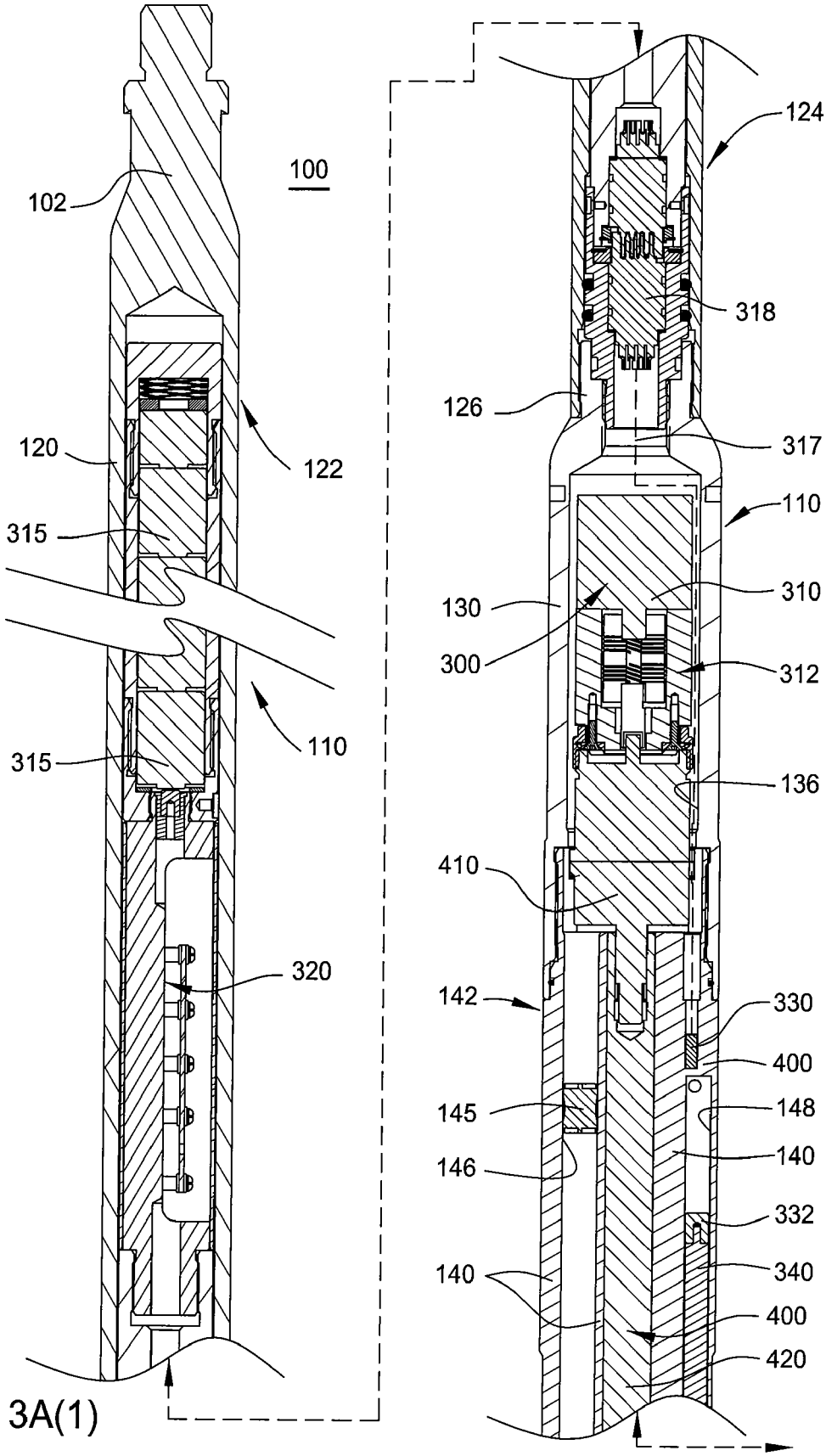
FIG. 3A(1)

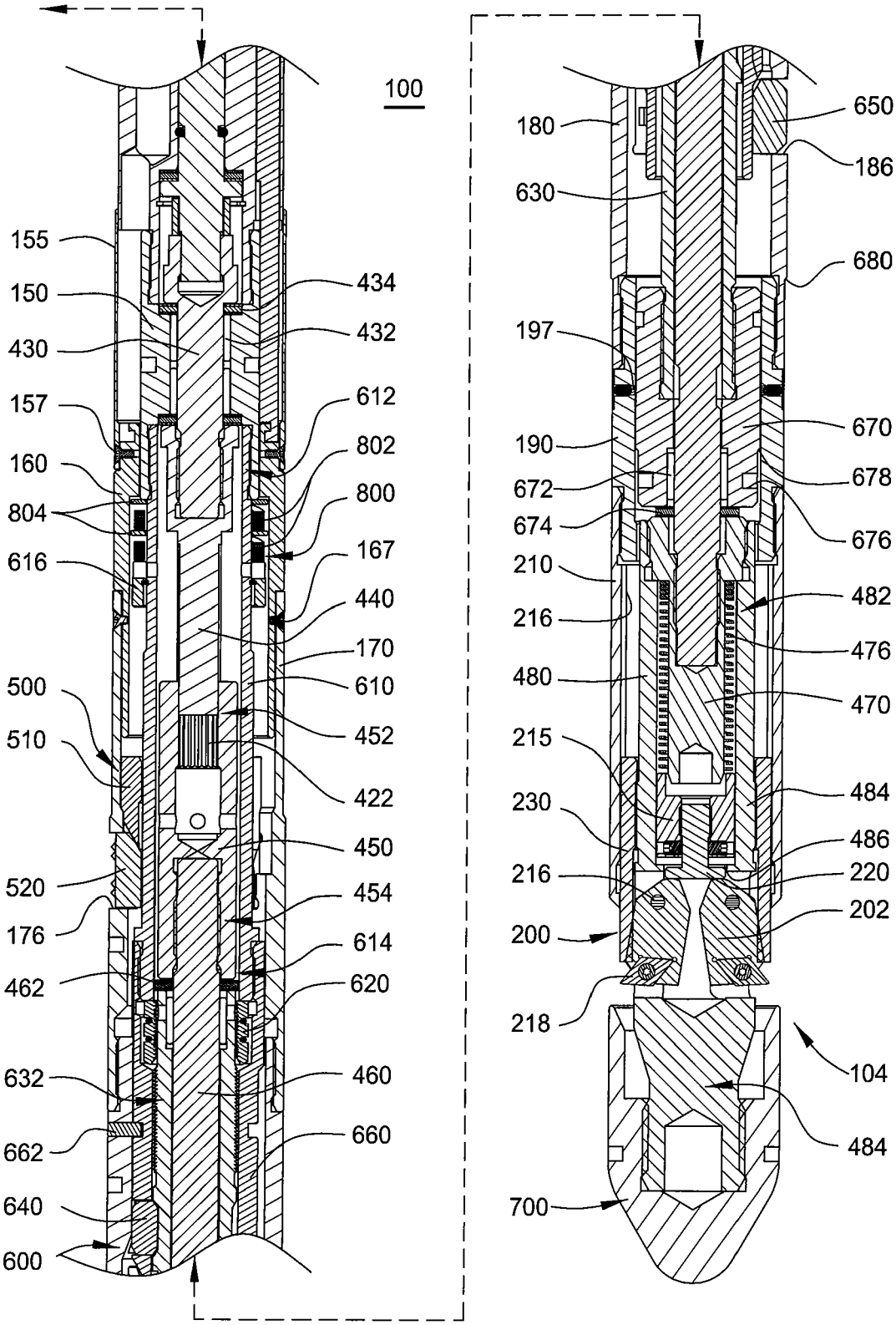
FIG. 3A(2)

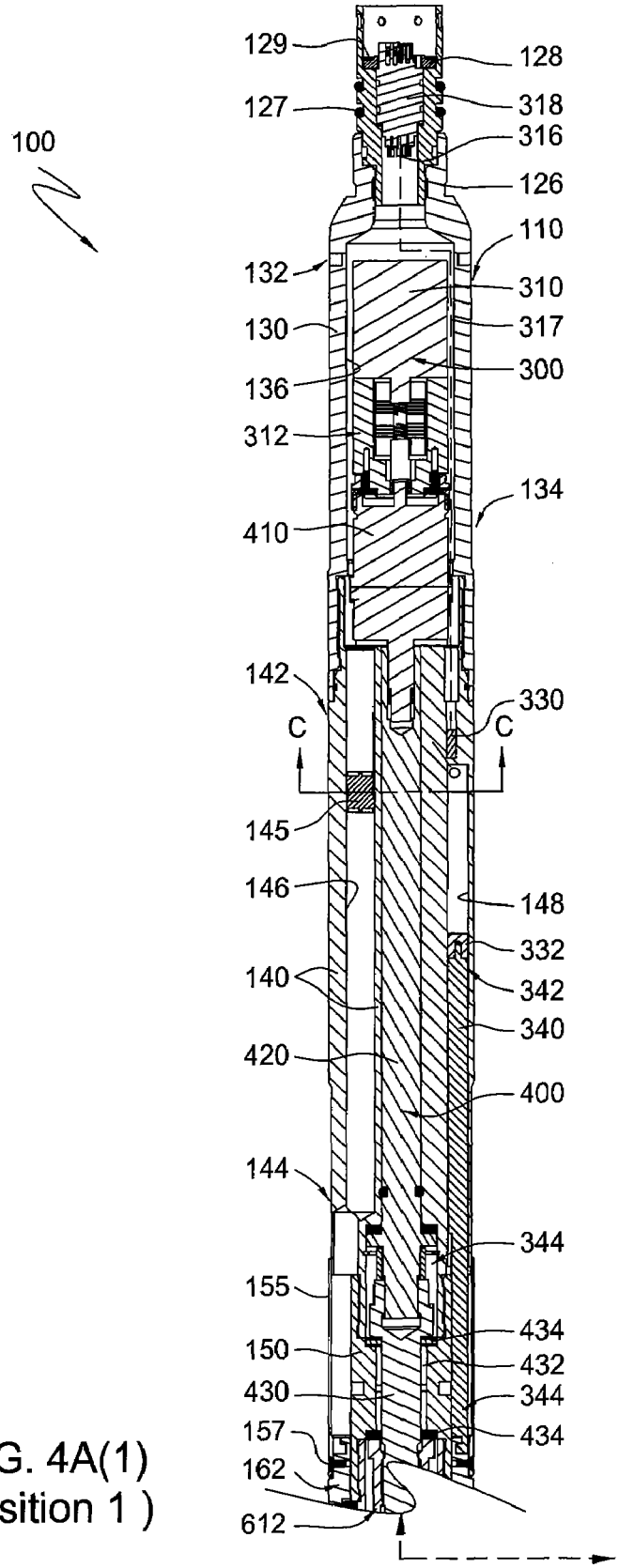
FIG. 4A(1)
(Position 1 )

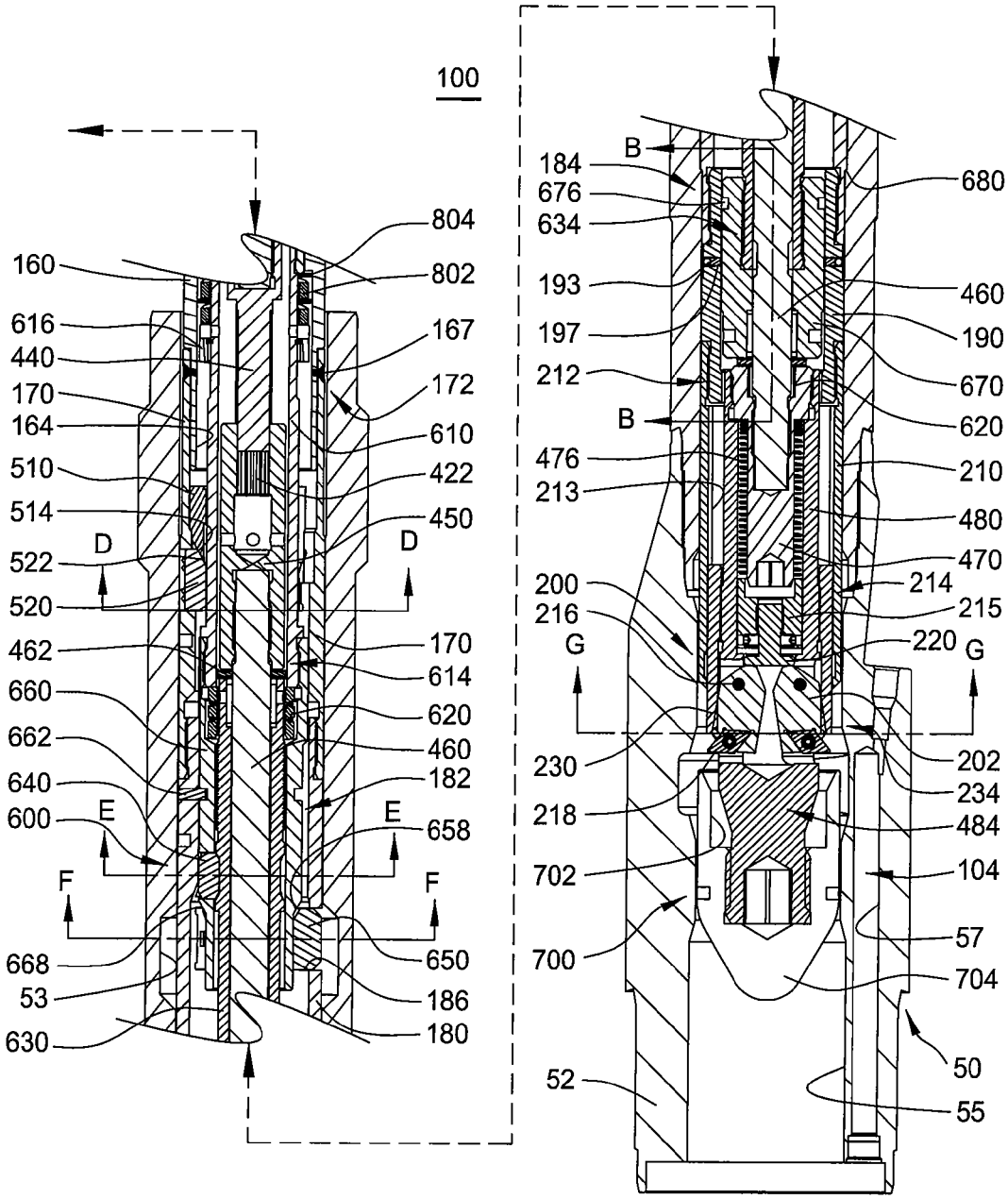
FIG. 4A(2)
(Position 1 )

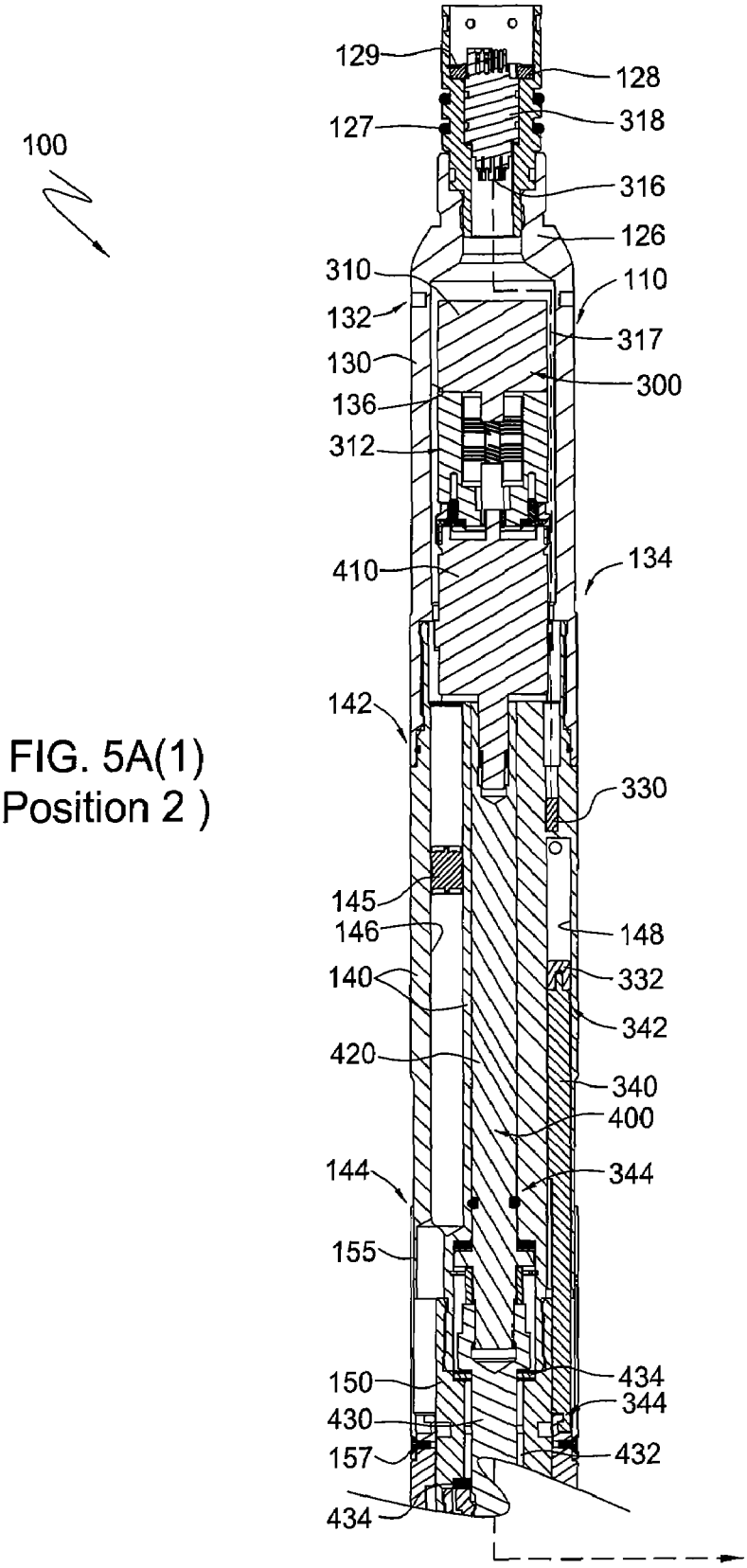
FIG. 5A(1)
(Position 2 )

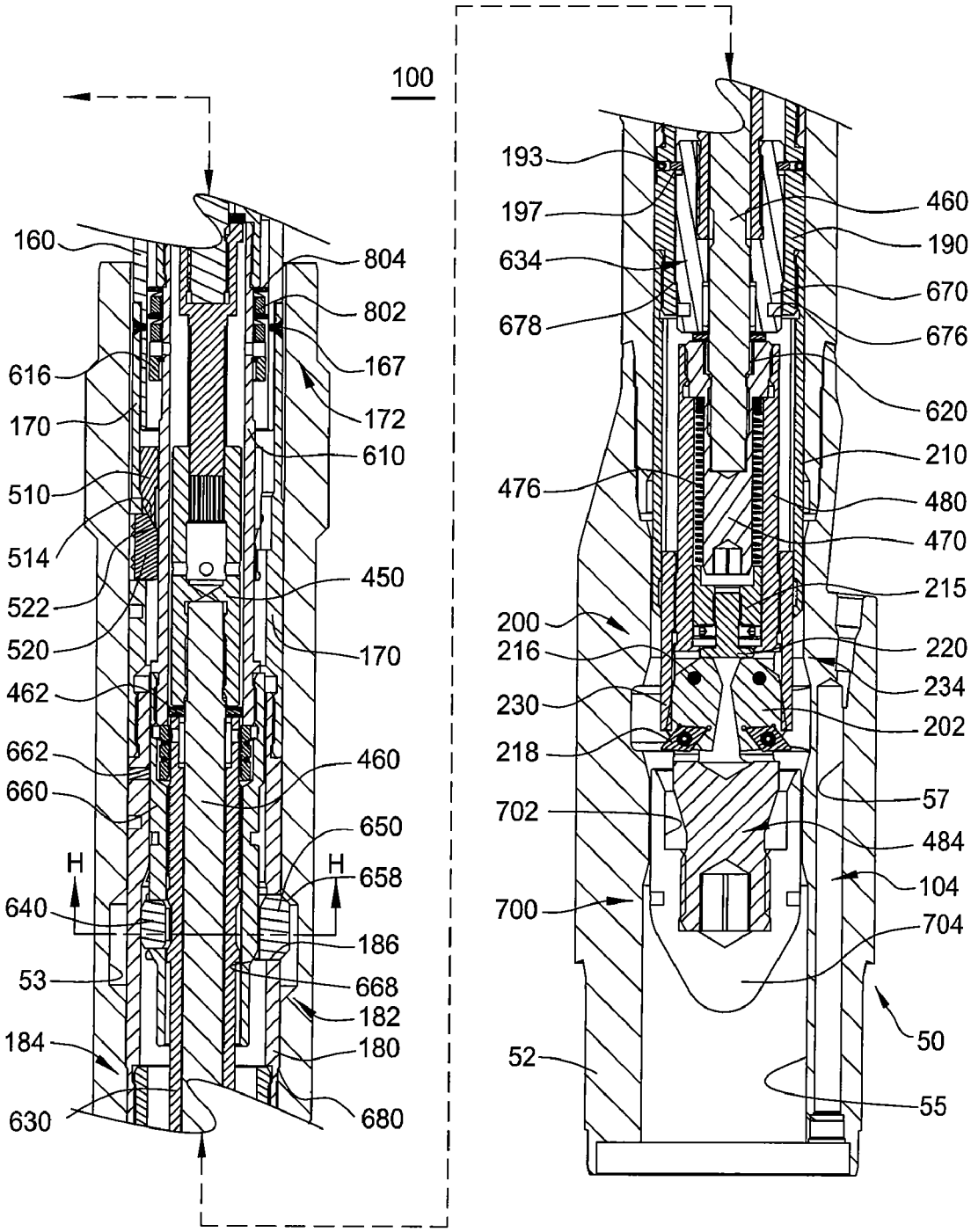
FIG. 5A(2)
(Position 2 )

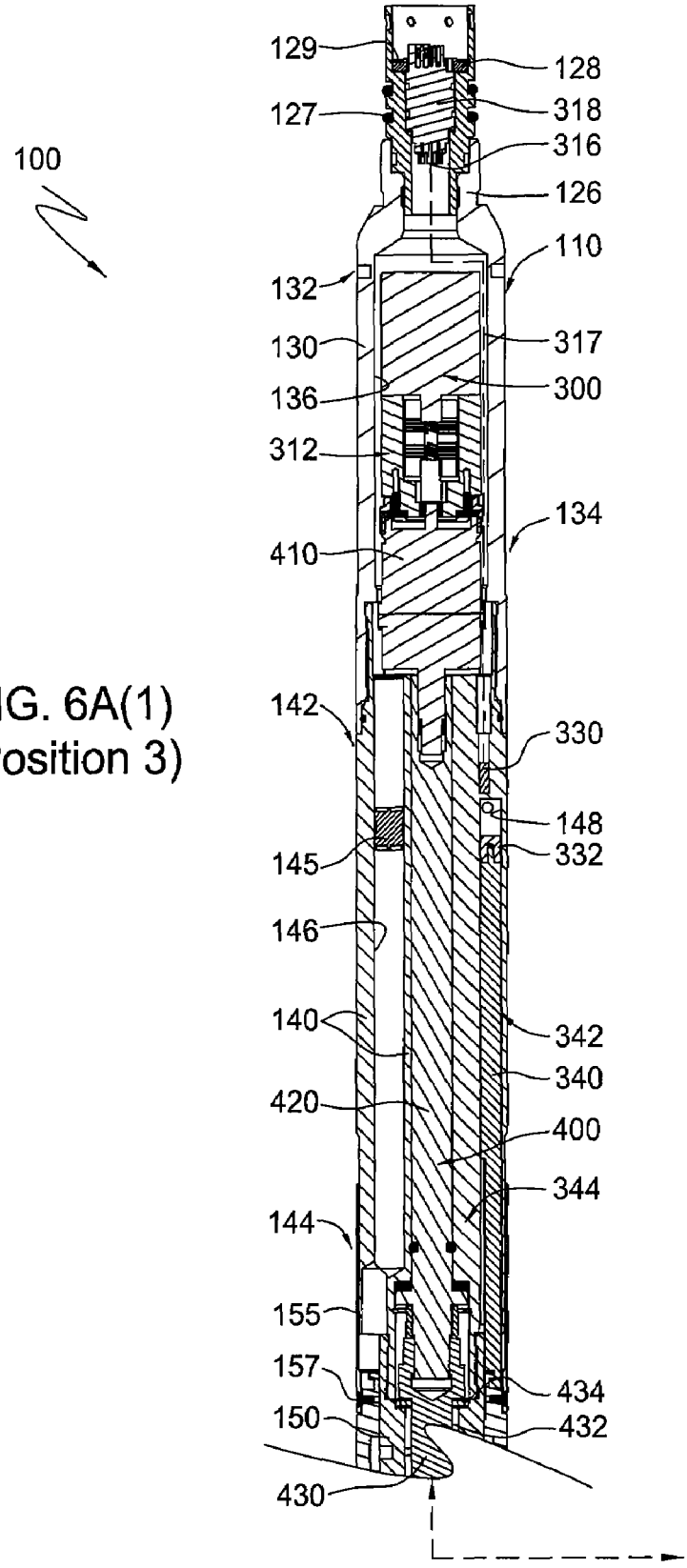
FIG. 6A(1)
(Position 3)

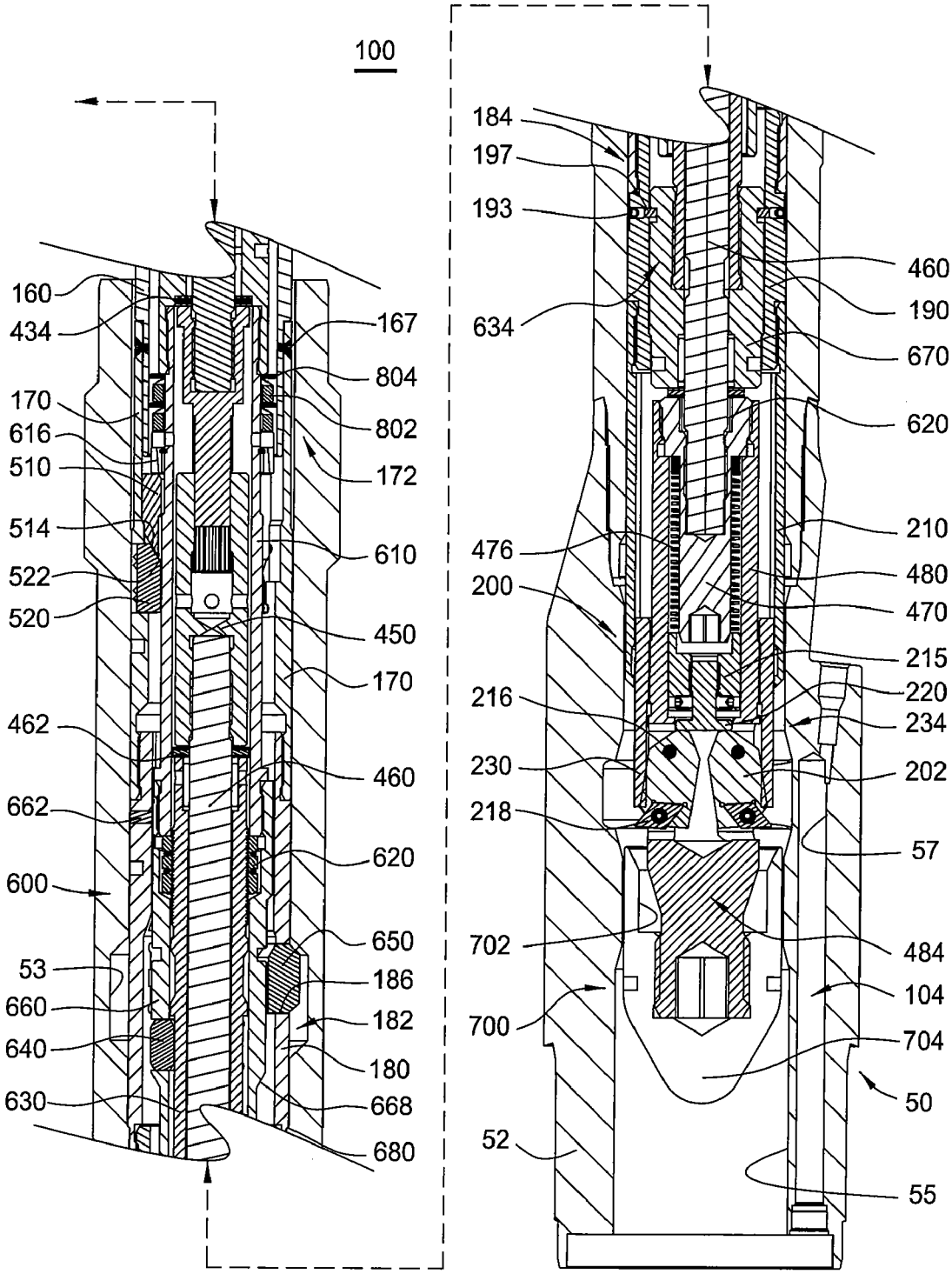
FIG. 6A(2)
(Position 3)

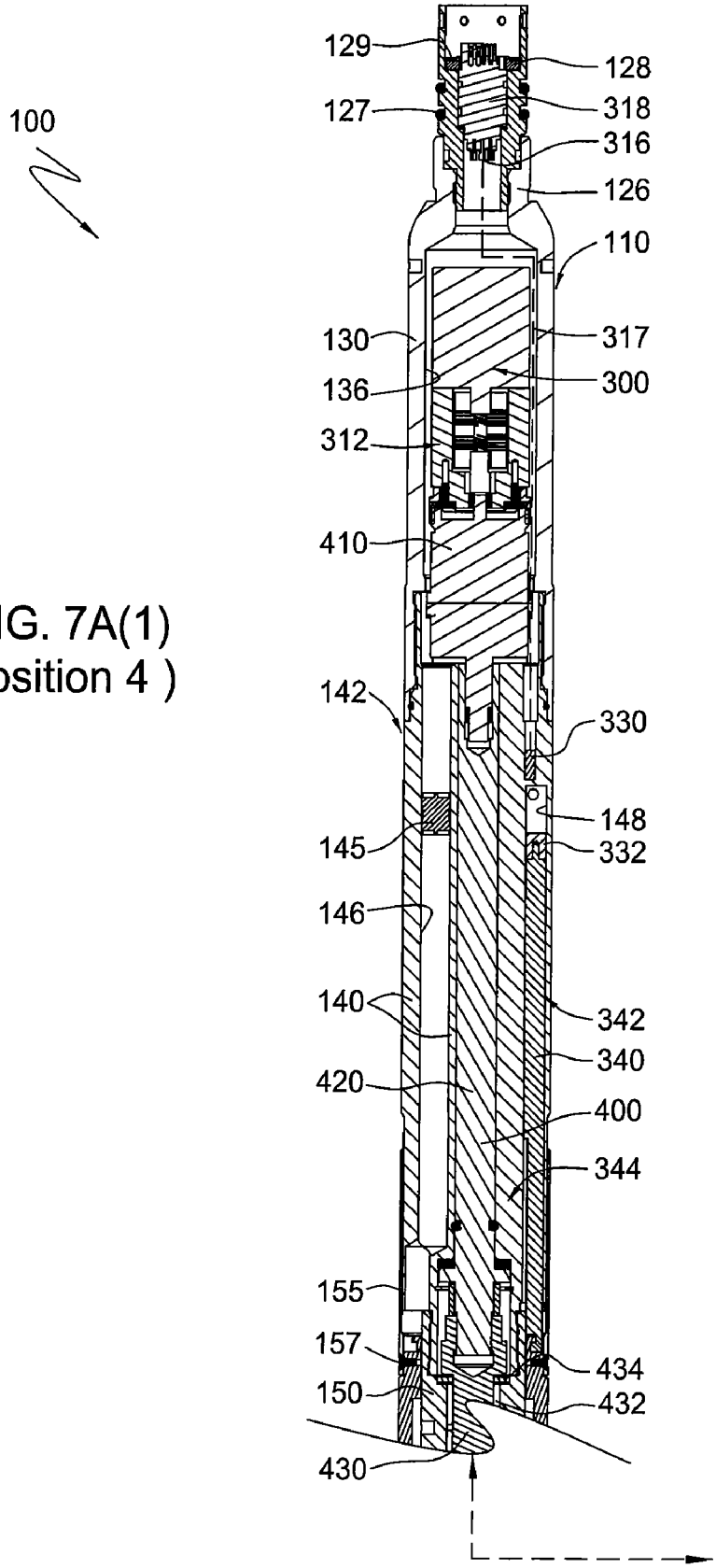
FIG. 7A(1)
(Position 4 )

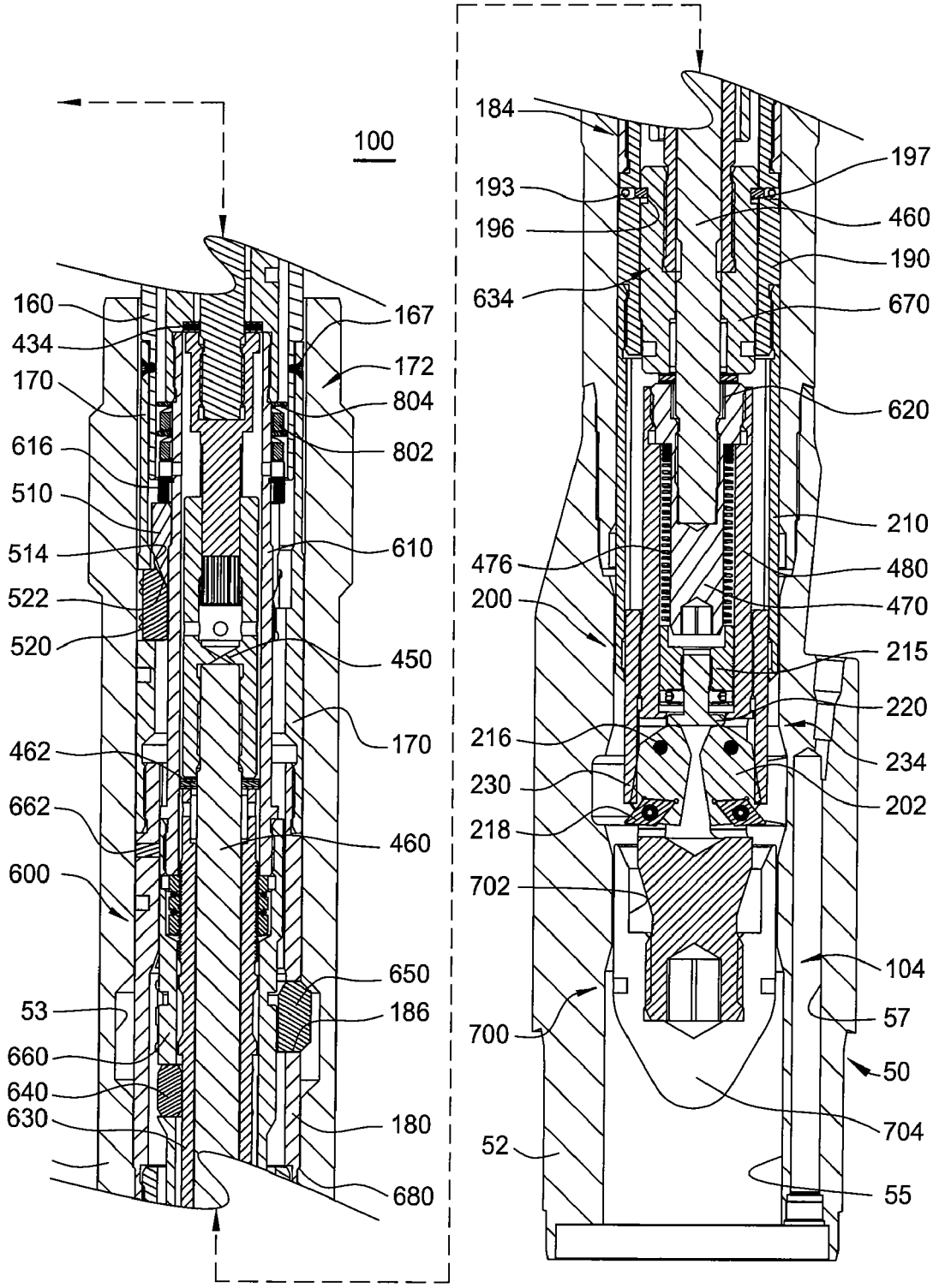
FIG. 7A(2)
(Position 4 )

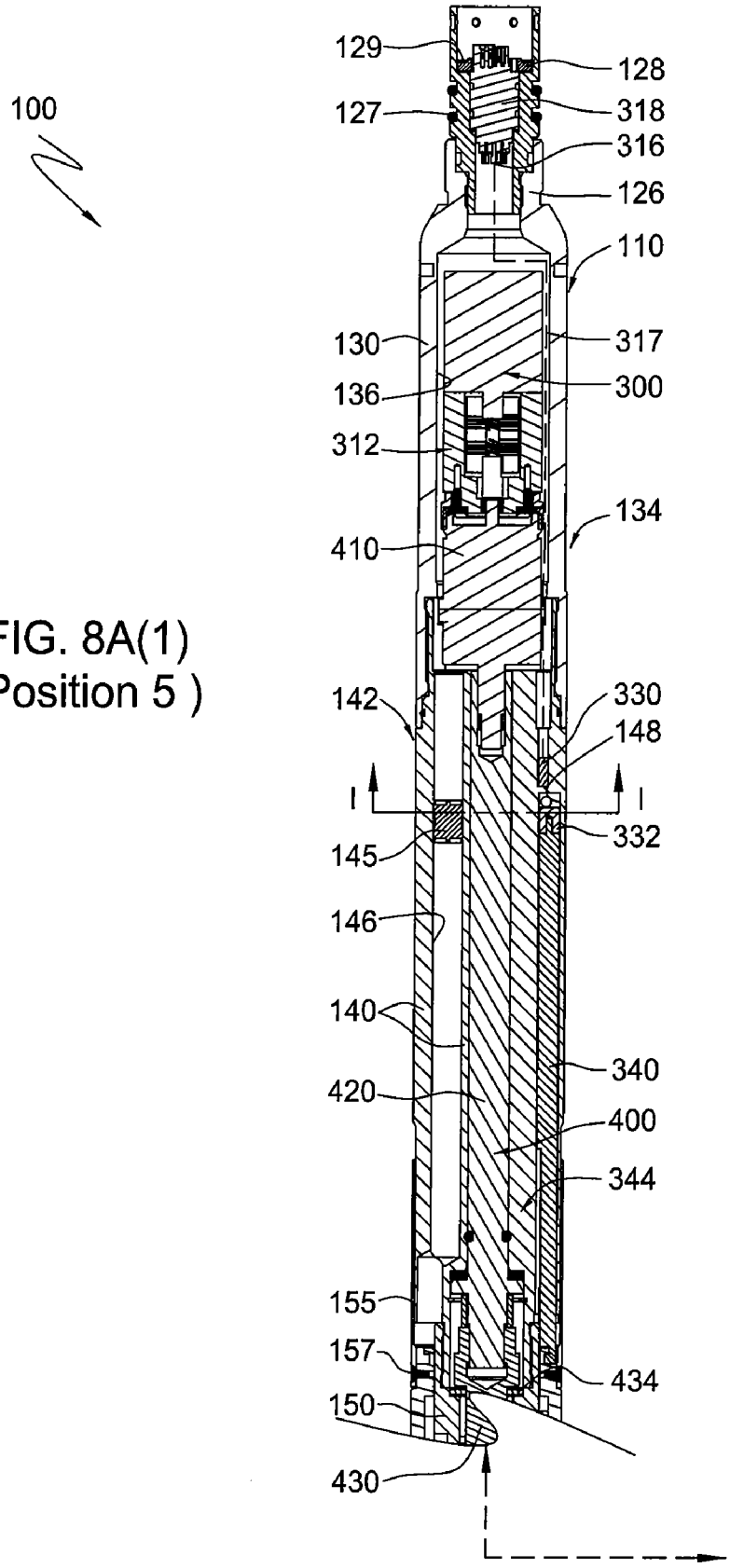
FIG. 8A(1)
(Position 5 )

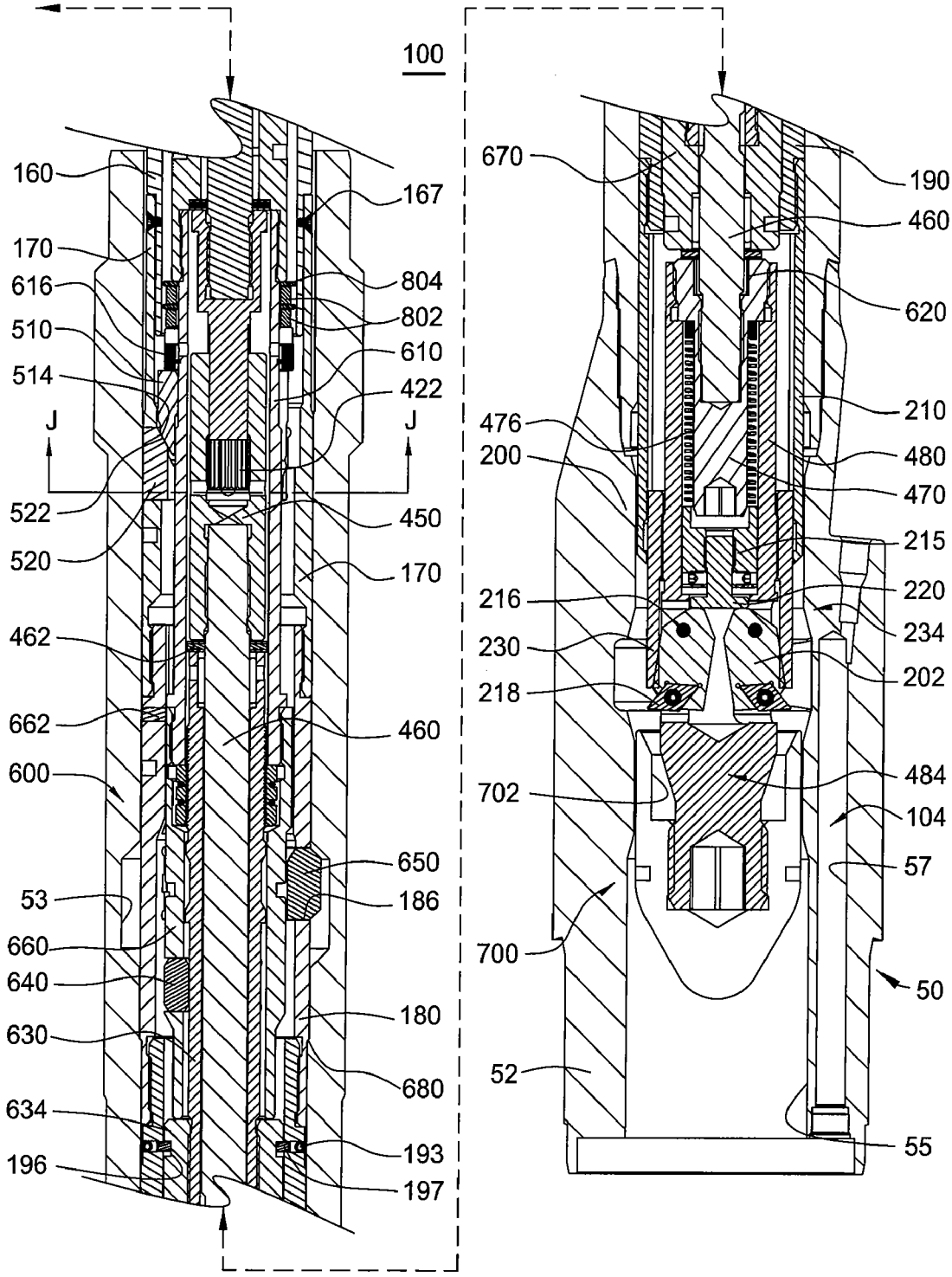
FIG. 8A(2)
(Position 5 )

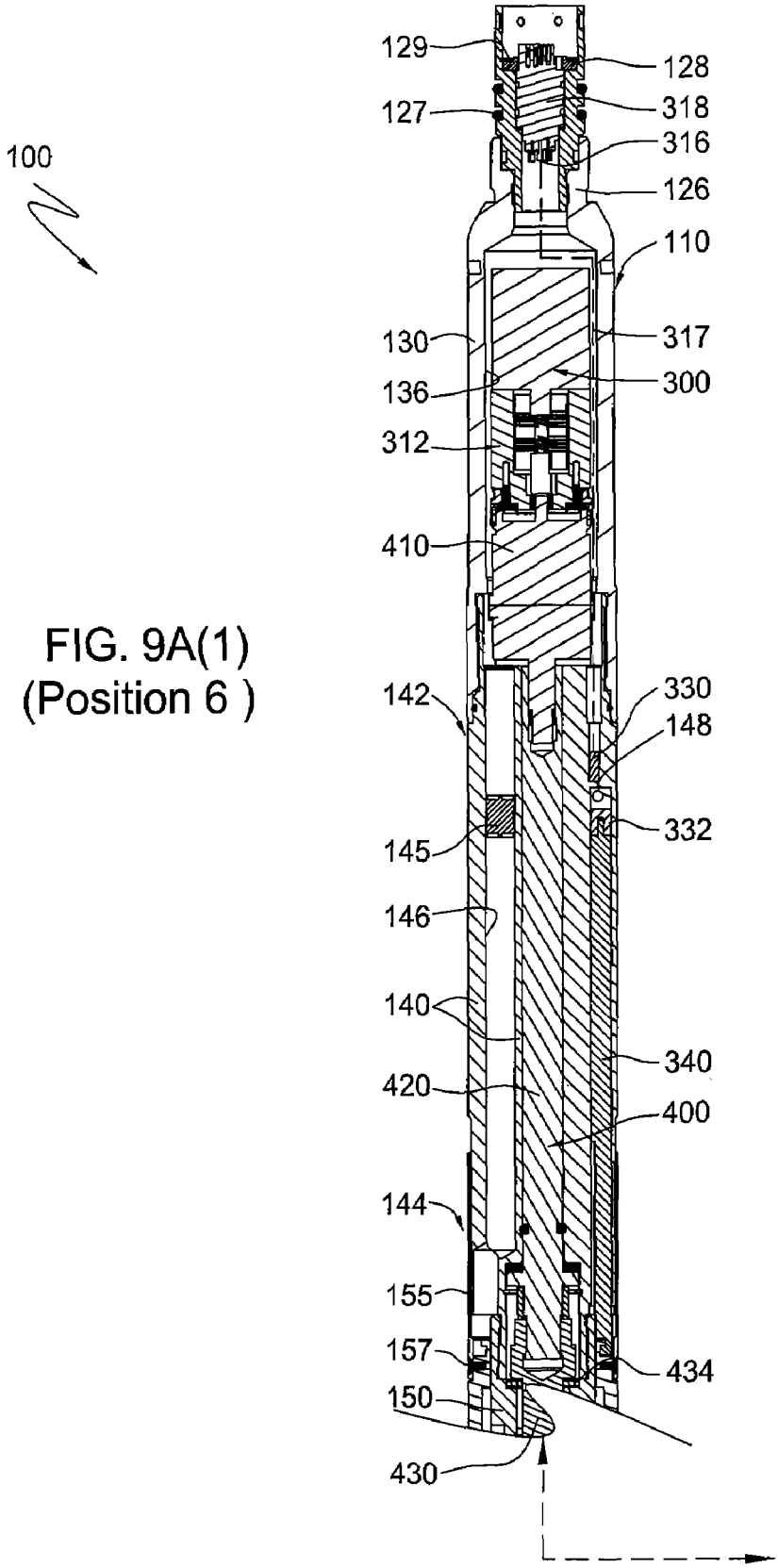
FIG. 9A(1)
(Position 6 )

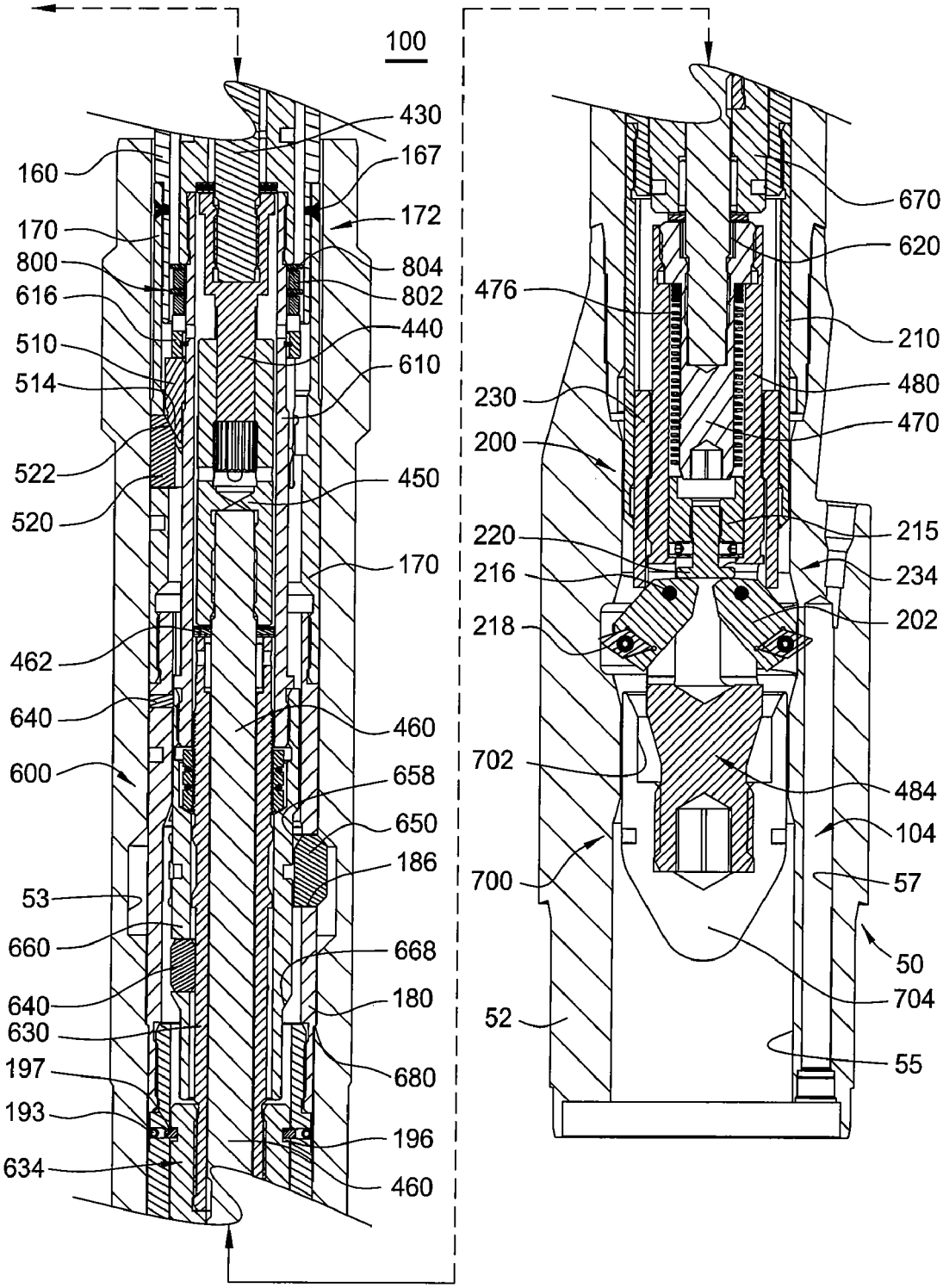
FIG. 9A(2)
(Position 6 )

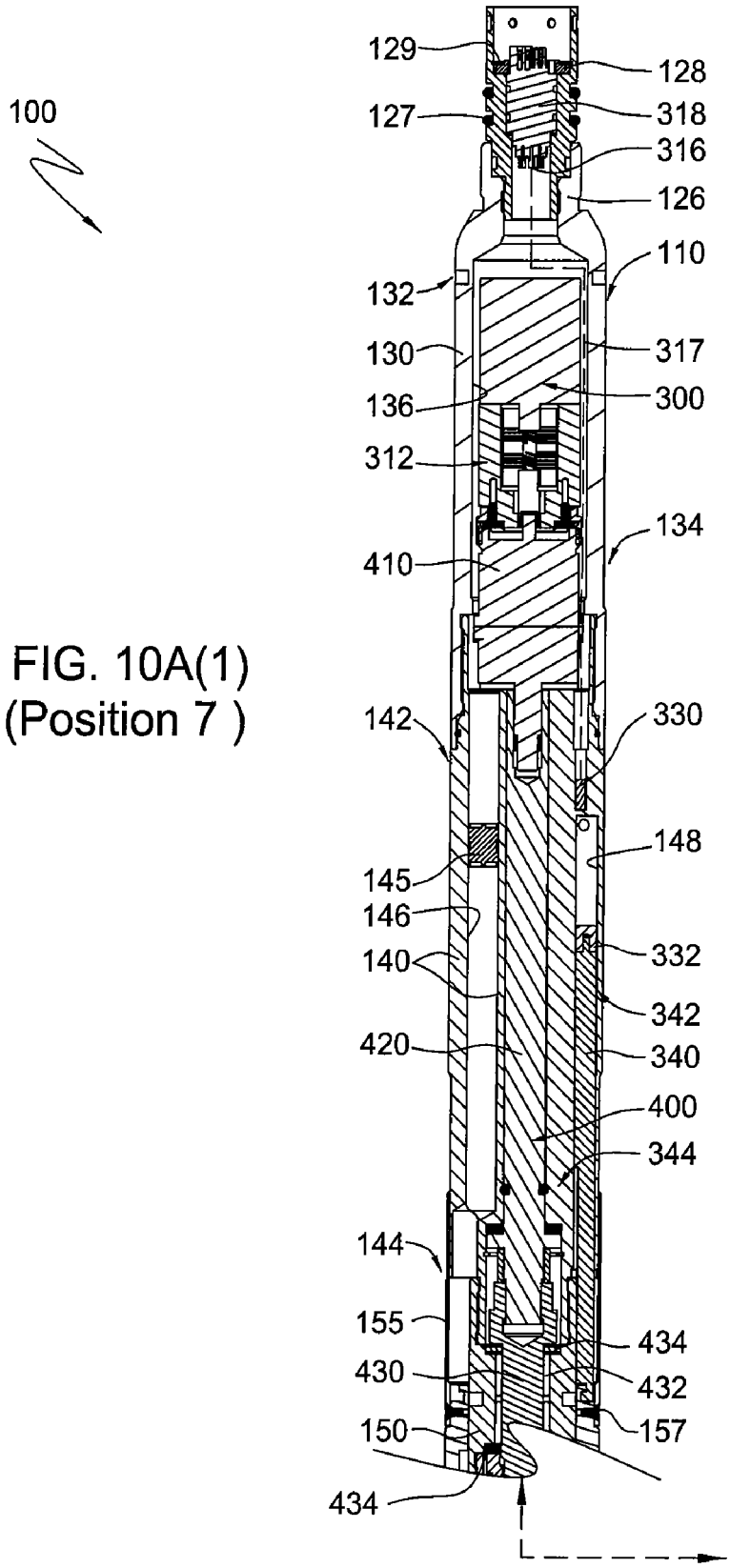
FIG. 10A(1)
(Position 7 )

(POSITION 7 )

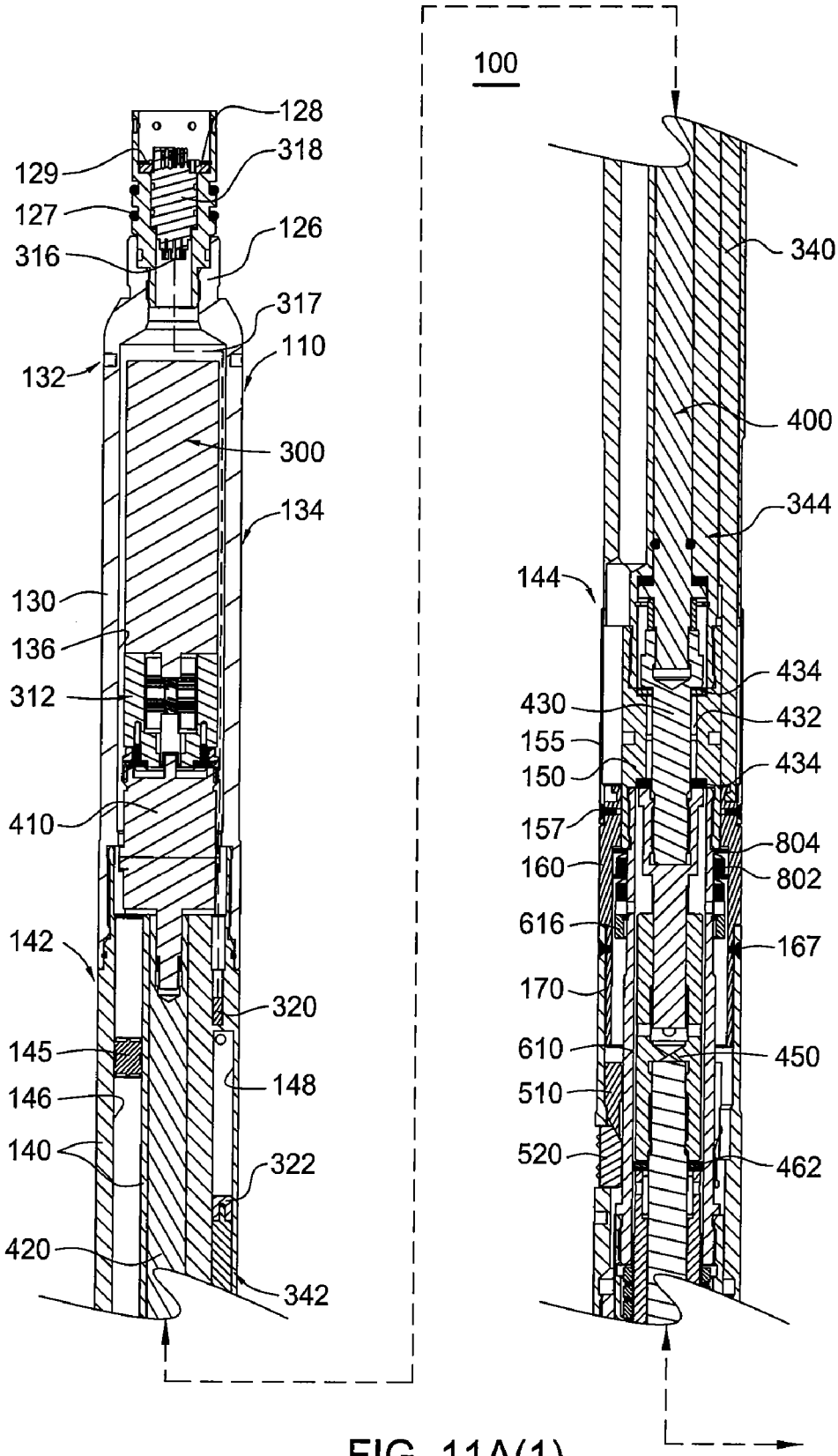
FIG. 11A(1)

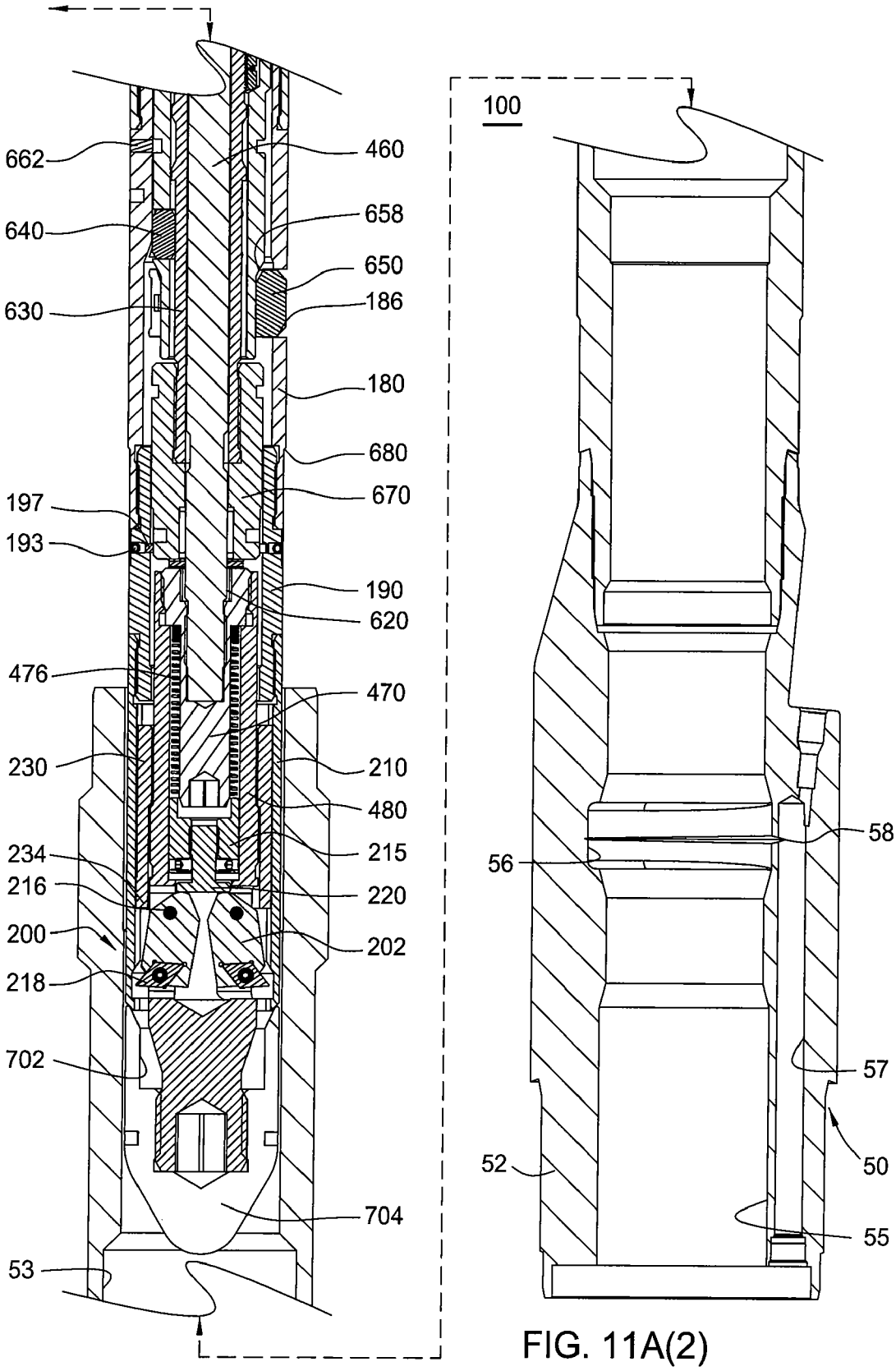
FIG. 11A(2)

DOWNHOLE MILLING MACHINE AND METHOD OF USE

RELATED APPLICATIONS

This application is a divisional of U.S. patent application Ser. No. 10/407,391, filed Apr. 4, 2003, now U.S. Pat. No. 7,188,674, which claims benefit of U.S. provisional patent application Ser. No. 60/408,366 filed on Sep. 5, 2002. Each of the aforementioned related patent applications is herein incorporated by reference.

BACKGROUND OF THE INVENTION

1. Field of the Invention

This invention is related generally to milling tools. More particularly, this invention pertains to an apparatus and method for penetrating a tubular body within a wellbore in order to establish a path of fluid communication between inner and outer surfaces of the tubular. In addition, the present invention relates to a milling tool that creates a path of fluid communication from a tubing retrievable subsurface safety valve, to a wireline retrievable subsurface safety valve in order to provide hydraulic pressure to operate the wireline retrievable safety valve.

2. Description of the Related Art

In hydrocarbon producing wells completed with production, there is often a need to cut, punch, drill, mill, dissolve or otherwise remove material in-situ deep in a well. In some cases, cutting the production tubing is desirable. In others, releasing a packer, parting a sleeve, or opening a communication port is the objective. The present invention provides a milling machine that is adapted for use downhole, and may be used in a variety of applications.

A milling machine, in general terms, is a device that has a cutting head rotated against a stationary body. The cutting head includes a blade that cuts against the stationary body, such as a tubular body within a wellbore. Various types of milling machines are known. For example, mill bits are sometimes used in order to cut through a string of casing in order to form a lateral borehole within a wellbore. In such instances, a milling bit is urged downwardly against a diverter tool, such as a whipstock, in order to force the milling bit to grind against the inner surface of the casing. An elongated, elliptical opening, known as a "window," is thus formed.

A disadvantage to such milling apparatuses is the difficulty in making a cut at a precise location downhole. For example, it is sometimes desirable to penetrate the housing of a tubing-retrievable safety valve in order to create a path of fluid communication from the hydraulic pressure source of the tubing-retrievable safety valve, into the interior bore of the safety valve. This occurs when the tubing-retrievable safety valve has malfunctioned. In such an instance, it is desirable run a second, wireline-retrievable subsurface safety valve (WRSSV) into the wellbore adjacent the defective tubing-retrievable subsurface safety valve (TRSSV), and utilize the hydraulic pressure source of the tubing-retrievable safety valve to operate the wireline-retrievable safety valve. However, there heretofore has been no known mechanical means for accomplishing this milling process.

By way of background, Subsurface Safety Valves (SSVs) are often deployed in hydrocarbon producing wells to shut off production of well fluids in emergency situations. Such SSVs are typically fitted into production tubing in the wellbore, and operate to block the flow of formation fluids upwardly through the production tubing should a failure or hazardous condition occur at the well surface.

The SSV typically employs a valve closure member, or "flapper," that is moveable between an open position and a closed position. In this respect, the flapper is typically pivotally mounted to a hard seat. When the flapper is in its open position, it is held in a position where it pivots away from the hard seat, thereby opening the bore of the production tubing. However, the flapper is strongly biased to its closed position. When the flapper is closed, it mates with the hard seat and prevents hydrocarbons from traveling up the wellbore to the surface.

The flapper plate of the safety valve is held open during normal production operations. This is done by the application of hydraulic fluid pressure transmitted to an actuating mechanism. A common actuating mechanism is a cylindrical flow tube, which is maintained in a position adjacent the flapper by hydraulic pressure supplied through a control line. The control line resides within the annulus between the production tubing and the well casing, and feeds against a piston. The piston, in turn, acts against the cylindrical flow tube, which in turn moves across the flapper within the valve to hold the flapper open. When a catastrophic event occurs at the surface, hydraulic pressure from the control line is interrupted, causing the cylindrical flow tube to retract, and allowing the flapper of the safety valve to quickly close. When the safety valve closes, it blocks the flow of production fluids up the tubing. Thus, the SSV provides automatic shutoff of production flow in response to well safety conditions that can be sensed and/or indicated at the surface. Examples of such conditions include a fire on an offshore platform, sabotage to the well at the earth surface, a high/low flow line pressure condition, a high/low flow line temperature condition, and simple operator override.

If the safety valve is "slickline retrievable", it can be easily removed and repaired. However, if the SSV forms a portion of the well tubing, i.e., it is "tubing retrievable", the production tubing string must be removed from the well to perform any safety valve repairs. Removal and repair of a tubing retrievable safety valve is costly and time consuming. It is usually advantageous to delay the repair of the TRSSV yet still provide the essential task of providing well safety for operations personnel while producing from the well. To accomplish this objective, the tubing-retrievable safety valve is disabled in the open position, or "locked out". This means that the valve member, i.e., flapper or "flapper plate," is pivoted and permanently held in the fully opened position.

In normal circumstances, if the well is to be left in production, a WRSSV may be inserted in the well, often in lockable engagement inside the bore within the locked out TRSSV. Because of the insertion relationship, the WRSSV necessarily has a smaller inside diameter than the TRSSV, thereby reducing the hydrocarbon production rate from the well. Locking out the safety valve will not eliminate a need for remediation later, but the lockout and use of the WRSSV will allow the well to stay on production (most often, with a reduced production rate) or perform other work functions in the tubing until the TRSSV can be repaired or replaced.

A novel apparatus and method for locking out a tubing-retrievable safety valve is presented in the pending patent application entitled "Method and Apparatus for Locking Out a Subsurface Safety Valve." That patent application was filed provisionally on Jul. 12, 2002, and was assigned Ser. No. 60/395,521. A conventional application will be filed under the same title, shortly. That application is incorporated herein fully by reference.

As noted, once a TRSSV is locked out, it is desirable to run in a WRSSV adjacent the TRSSV. In other words, the WRSSV is inserted into the bore of the TRSSV, and then operated in order to provide the safety function of the original TRSSV. This is a more cost-effective alternative to pulling the tubing and attached TRSSV from the wellbore. In order to operate the new WRSSV, a hydraulic fluid source is needed to hold the flapper member of the new WRSSV open. It is preferred to employ the hydraulic flow line already in place for the TRSSV in order to operate the WRSSV. This requires that a communication path be opened between the hydraulic fluid pressure line from the old TRSSV to the new WRSSV.

The present invention is directed to a novel method and apparatus for milling a downhole groove into a tool such as a TRSSV deep in a wellbore. The present inventions are disclosed in the context of creating a path of fluid communication between a TRSSV and a WRSSV disposed therein. However, it is understood that the present inventions are not limited to such use, but that the inventions have many other downhole uses.

Various types of communication devices and methods have been proposed in U.S. Pat. Nos. 3,799,258; 4,944,351; 4,981,177; 5,496,044; 5,598,864; 5,799,949; and 6,352,118. In some of these patents, various additional parts are necessary to enable communication. Where such parts are integral to each and every valve, cost and complexity are obviously added to the valve assemblies. Moreover, modern SSVs are extraordinarily reliable, and such integral communication mechanisms are not used except in a fraction of the total valve population; nevertheless, integral communication mechanisms are included, and add unnecessary cost to most prior art SSV assemblies. Further, integral communication mechanisms may themselves fail to work for various reasons, primarily because the communication mechanisms reside with the SSV's in the harsh downhole environment. Adverse forces include high temperature, high flow rate, sand, corrosion, scale and asphaltine buildup. The forces can cause a failure of the communication mechanism to provide the needed fluid passageway through the TRSSV, and add large and unexpected workover costs.

Other inventors have realized the disadvantages of integral communication mechanisms, and inventions have been disclosed in the US patents discussed below. The trend in these inventions points to a need to remove integral communication mechanisms and requisite structure from the SSV, but none, until the present invention, accomplishes this objective in a reliable, precise, mechanical way.

U.S. Pat. No. 3,799,258 (Tausch '258) discloses a subsurface well safety valve for connection directly to a well tubing for shutting off flow of well fluids through the tubing when adverse well conditions occur. This patent discloses a TRSSV that includes a means for supporting a WRSSV in the event that the first safety valve becomes inoperative. Tausch '258 is instructive wherein the insertable relationship between the TRSSV and the WRSSV is clearly depicted. Tausch '258 provides a fluid control line extending from the surface to a first safety valve. The first safety valve includes a port communicating with the control line and having a shearable device. The shearable device initially closes the port; however, when sheared, it opens the port to allow fluid communication between the hydraulic flow line and the inner bore of the first safety valve. From there, fluid communicates with and controls a second safety valve supported in the first valve bore. A disadvantage to the arrangement of Tausch '258 is that the shearable means can be accidentally sheared during slickline operations, causing hydraulic pressure loss and a malfunction of the first safety valve, i.e., a TRSSV. Further, the device requires a moving sleeve that can become stuck and fail after years of residence in an oil or gas well. Finally, the moving sleeve adds cost to each and every well, whether or not the primary SSV ever fails.

U.S. Pat. No. 4,981,177 (Carmody '177) provides a device integral to a downhole tool, such as a safety valve or a stand-alone nipple. The device has a tubular housing with an axially extending bore being provided along the housing. A radially extending recess is provided in the internal bore wall of the housing, encompassing the axially extending bore. A control fluid pipe is passed through the bore and the recess. A cutting tool is mounted for radial movements in the recess and is actuated by downward jarring forces imparted by an auxiliary tool. When the cutting tool is actuated, the control pipe is severed, and the lower severed end portion of the control pipe is concurrently crimped to close such end portion. This device again adds cost to each and every valve in each and every well, whether or not the primary SSV ever fails. Moreover, the device incorporates moving parts that can become stuck and fail after years of residence in an oil or gas well.

U.S. Pat. No. 4,944,351 (Eriksen, et al. '351) provides a similar method and apparatus to Tausch '258 and Carmody '177. This device features an internally projecting integral protuberance in the bore of the original safety valve housing. A connecting fluid conduit is provided between the interior of the protuberance and the existing control fluid passage. A cutting tool is also integral to the TRSSV, and is mounted on an axially shiftable sleeve disposed immediately above the protuberance. The axially shiftable sleeve is manipulated by a slickline tool that is inserted in the bore of the TRSSV. Movement of the sleeve causes the cutting tool to remove the protuberance, and thus establish fluid communication between the control fluid and the internal bore of the TRSSV housing. Continued well control is assured as control fluid pressure supplied through the opening provided by the severed or removed protuberance operates an inserted WRSSV. However, the protuberance can be accidentally sheared or otherwise damaged during slickline operations, causing hydraulic pressure loss and a malfunction of the TRSSV. Further, the device requires a moving sleeve that can become stuck and fail after years of residence in an oil or gas well. The sleeve is provided in every valve whether used or not, and adds cost to the device.

U.S. Pat. No. 5,496,044 (Beall '044) and U.S. Pat. No. 5,799,949 (Beall '949) recognize the need to remove structure from the TRSSV. The devices of Beall '044 and Beall '949 have internal and external metal-to-metal radially interfering seals that provide an annular chamber. Communication with the annular chamber is established by a slickline tool adapted to punch a hole through the wall of the TRSSV and into the annular chamber. The annular chamber is necessary because the slickline punch tool cannot radially orient to a hydraulic piston hole formed in the TRSSV. The hydraulic chamber undesirably adds a potential leak path if the radially interfering metal-to-metal seals leak. This can cause the premature failure of the TRSSV. The existence of the annular chamber also adds an additional thread to the TRSSV, and the cost associated therewith to each and every TRSSV.

U.S. Pat. No. 5,598,864 (Johnston, et al. '864) discloses a subsurface safety valve, i.e., TRSSV, that has a plug inserted within an opening in the valve housing. This opening is in fluid communication with the piston and hydraulic cylinder assembly of the valve. The plug is adapted to be displaced from the opening to lock out the tubing-retrievable safety valve, and to establish secondary hydraulic fluid communication with an interior of the safety valve in order to operate a secondary WRSSV. The WRSSV is deployed in the primary valve (TRSSV) by slickline, and engages a profile in the TRSSV. Downward force to the deployed WRSSV causes a bolt to shear, thereby pulling the plug out of the opening in the TRSSV and establishing communication. This integral arrangement again adds cost to each and every valve in each and every well, whether or not the primary SSV ever fails. Moreover, the device adds parts that can become stuck or fail after months or years of idle residence in an oil or gas well.

Next, U.S. Pat. No. 5,201,817 (Hailey '817) provides an improvement for a downhole cutting tool otherwise used for many years. This device is used to cut through oilfield tubulars, such as tubing string. The Hailey '817 patent mentions the cleanout of debris, cement, mud, and other materials within a tubular. The cutting action of this tool is rather coarse and cannot be carefully controlled so as to not damage the pressure integrity of a SSV or other downhole device.

Finally, U.S. Pat. No, 6,352,118 (Dickson '118) recognizes the positive attributes of having no additional integral SSV parts to enable communication. Dickson '118 describes a tubular apparatus that delivers a dispersed jet of fluid referred to as a "chemical cutter." The tubular tool is landed within a TRSSV, and the chemical fluid is then directed against the inner wall of the TRSSV. In operation, the chemical acts against the material of the TRSSV in order to form an opening that provides fluid communication from between the hydraulic fluid source for the valve, and the inner bore.

"Chemical cutters" have been used for decades in the oil industry to "cut" tubing, and are indeed a well-known idiom in the oilfield lexicon. However, a more technically accurate definition is "a chemical reaction of an acid and a base to dissolve a portion of a tool." The method of Dickson '118 relies on placing a strong acid or other reactant in a local area until the base material is dissolved in situ. This dissolution ostensibly gives an operator the desired result of establishing a communication pathway through the TRSSV. The downside of the apparatus of Dickson '118 is the reliability of the dissolution on a variety of common SSV materials, and the uncertainty of containment of the reaction. For example, if the acid dissolves through the pressure containing body of the TRSSV or contacts the flow tubes, the planned workover can no longer be completed. The completion must be removed from the well, creating expenses of potentially millions of dollars. If the value of the remaining hydrocarbons in the reserve do not justify total re-completion of the well, the result could be a complete loss of the well.

In fairness, the Dickson '118 patent mentions alternatives to chemical cutters. These are listed as "a mechanical cutting tool" and an "explosive cutting mechanism." However, Dickson '118 never discloses or describes any embodiment or means for utilizing either a mechanical cutting tool or an explosive cutting arrangement within a TRSSV. To the knowledge of the inventors herein, such tools have remained unknown.

There is a need, therefore, for a mechanical communication tool that requires no additional integral SSV parts to enable communication. There is a further need for a communication tool that can be deployed by slickline, and mechanically establishes a fluid communication path from the hydraulic chamber of a primary TRSSV to a secondary WRSSV by milling a groove of a controlled depth in a precise location, and can be used to establish communication in any type of safety valve.

A note about the terms "slickline" and "wireline" is in order: Historically, the term "wireline" has been used to describe all tools lowered in a well that hang on a small diameter wire. Developments in the last several years have some tools being lowered in the well on an "electric line", where the line not only provides hanging support for the tools, but also provides power and/or communication channels for an electrically operated tool. Often these tools are suspended by braided umbilical cables, and in the most current oilfield vernacular, have also come to be known as "wireline" tools.

Most tools lowered in wells today are mechanical in nature, and require no electric power to operate. In the past, these tools were known as "wireline" tools. However, with the advent of electrical tools, the mechanical tools are now commonly referred to as "slickline" tools rather than "wireline" tools.

One embodiment of the present invention is a "slickline tool" because it is deployed with a battery stack and requires no external power for operation. Typically, slickline operations are less complex than wireline. However, it is obvious that the present invention could also be configured to be deployed on an electrically charged "wireline". Therefore, for purposes of the present application, the term "slickline" includes cables, electrical lines and wirelines of whatever type.

SUMMARY OF THE INVENTION

The present invention presents an apparatus and method for forming an opening within the housing of a downhole tool, such as a tubing-retrievable subsurface safety valve (TRSSV). The apparatus defines a milling tool having a housing system, a cutting system, a drive system, and an actuation system. The milling tool is configured to be landed within the inner bore of a TRSSV, and is actuated so as to shave or otherwise mechanically form an opening through the inner bore of the TRSSV. In this manner, a pathway of communication is formed within the TRSSV between the hydraulic chamber (or fluid source) and the inner bore.

As noted, the milling tool first comprises a housing system. The housing generally defines an elongated tubular body for housing components of the tool. In one aspect, the housing system is comprised of a series of sub-housings generally disposed end-to-end. However, in one aspect the housing system is configured to permit a degree of telescopic collapsing of the housing system during the tool actuation process.

Next, the milling tool comprises a cutting system. The cutting system includes one or more blades that are disposed on a cutter head. The cutter head is rotated by a shaft in order to rotate the blades within the TRSSV. In one arrangement, the blades are biased outward so as to engage an inner surface of the housing for the tubing-retrievable safety valve when the cutting system is rotated.

Next, the milling tool comprises a drive system. The drive system is generally comprised of a rotary motor, and a shaft system rotating in response to the motor. The motor may be line powered via a wireline, or may be battery operated. In one aspect, a controller is also provided for regulating rotary movement of the motor and attached shaft system. The shaft system connects the motor and its gearbox to the cutter head further down the tool.

Finally, the milling tool has an actuation system. The actuation system actuates the motor system once the milling tool is landed into the TRSSV downhole. In one aspect, the actuation system is interlocked with one or more safety features, such as a delay timer and a pressure sensor. In this way, the actuating system will not place the motor of the drive system in electrical communication with the power source, e.g., batteries, until one or more conditions (such as a five minute delay, or a temperature of 300° F.) are reached.

A method is also provided for forming an opening within a tubing-retrievable subsurface safety valve. In this respect, a milling tool of the present invention is run into a wellbore. The apparatus may be run either at the lower end of a wireline, or at the lower end of a string of coiled tubing. The apparatus is lowered within the production tubing of a hydrocarbon wellbore, and landed in a landing profile of the TRSSV. This places the cutting system for the milling apparatus at the precise location needed within the TRSSV for milling the communication opening. It is preferred that the TRSSV be permanently locked out prior to running the milling tool into the wellbore. However, the scope of the present invention permits the milling and communication process to take place before the primary safety valve is locked out.

After the milling tool is located within the TRSSV, the actuation system is actuated. In one aspect, the actuation system defines a magnetically sensitive reed switch that closes an electrical circuit when placed in sufficient proximity with a magnet (or other magnetic force). Initiation of the actuation system actuates the drive system within the tool. This, in turn, transmits torque through the shaft system and to the connected cutting apparatus. A pathway for communication between the hydraulic flow line for the TRSSV and the inner bore of the TRSSV can then be formed. Afterwards, the milling apparatus is pulled out of the safety valve and from the production tubing within the hydrocarbon wellbore.

In operation, the communication tool of present invention may be used by lowering the tool into a well, locating the tool in the area to be milled, locking the tool in position, starting the motor, deploying the cutter head, milling a groove to establish fluid communication, and removing the downhole milling tool from the well.

BRIEF DESCRIPTION OF THE DRAWINGS

So that the manner in which the above recited features of the present invention are attained and can be understood in detail, a more particular description of the invention, briefly summarized above, may be had by reference to the appended drawings. It is to be noted, however, that the appended drawings illustrate only typical embodiments of this invention and are therefore not to be considered limiting of its scope, for the invention may admit to other equally effective embodiments.

FIGS. 3A(1)-A(2) present a cross sectional view of the milling tool of FIG. 1. The housing system, cutting system, drive system, and actuation system of the tool are all seen in this view. Visible within the housing are batteries for operating a motor within the tool, a controller for controlling the motor, and an electrical connector for electrically communicating with the actuation system and motor.

FIGS. 4A(1)-A(2) provide a cross sectional view of a portion of the milling tool of FIG. 1, in its run-in position. The tool is only seen from the flask connector, down. The milling tool has been landed within the housing of a tubing retrievable subsurface safety valve. The motor of the tool has not yet been actuated, and the blades of the cutting system remain recessed within the tool.

FIG. 4G is cut across line G-G of FIG. 4A(2). The view is cut through the blades for the actuating system of the tool. The blades have not yet been rotated.

FIGS. 5A(1)-A(2) show a new cross-sectional view of the milling tool of the present invention, in the embodiment of FIGS. 4A(1)-A(2). This view shows the tool in a second position. Downward force is being applied through the housing system of the tool, causing a shear pin in a shear pin housing to shear from the locating mandrel. This allows the locating mandrel and attached locking dogs to move downward in the tool such that the locking dogs are now at the level of the locating dogs.

FIGS. 6A(1)-A(2) provide a new cross-sectional view of the milling tool of FIGS. 4A(1)-A(2). This view shows the next step in the tool actuation process. Here, the housing system is beginning to telescopically collapse. The switch housing is seen being received within a sliding sleeve, drawing a rod and attached magnet closer to a reed switch within the switch housing.

FIGS. 7A(1)-A(2) present another cross-sectional view of the milling tool of FIGS. 4A(1)-A(2). The next step in the tool actuation process is provided. Further telescopic compression of the housing system has taken place, bringing the magnet closer to the reed switch. The reed switch is now magnetically initiated and is prepared to actuate the drive system of the tool. Also, a bearing housing and load ring have contacted the top of a set of cones.

FIGS. 8A(1)-A(2) demonstrate an additional cross-sectional view of the milling tool of FIGS. 4A(1)-A(2). A next step in the tool actuation process is again provided. Here, downward force is being applied through the bearing housing and load ring in order to drive the cones under a set of buttons.

FIGS. 9A(1)-A(2) provide is a cross-sectional view of the milling tool of FIGS. 4A(1)-A(2), and showing the next sequential step in the tool actuation process after FIGS. 8A(1)-A(2). In this step, the motor has been actuated, and is rotating the shaft system of the tool. It can be seen that a release sleeve has moved back from within a surrounding cutter head housing, thereby exposing the blades. The blades are biased outward, and have engaged the housing of the safety valve.

FIGS. 11A(1)-A(2) provide a final cross-sectional view of the tool of FIGS. 4A(1)-A(2). Here, the milling tool is being lifted out of the TRSSV, and from the wellbore. The eccentric cut formed in the valve housing as a result of the milling operation is seen. More specifically, an opening is seen through the housing, providing fluid communication between the hydraulic chamber of the TRSSV and the inner bore.

DETAILED DESCRIPTION OF CERTAIN PREFERRED EMBODIMENTS

Figure 1:
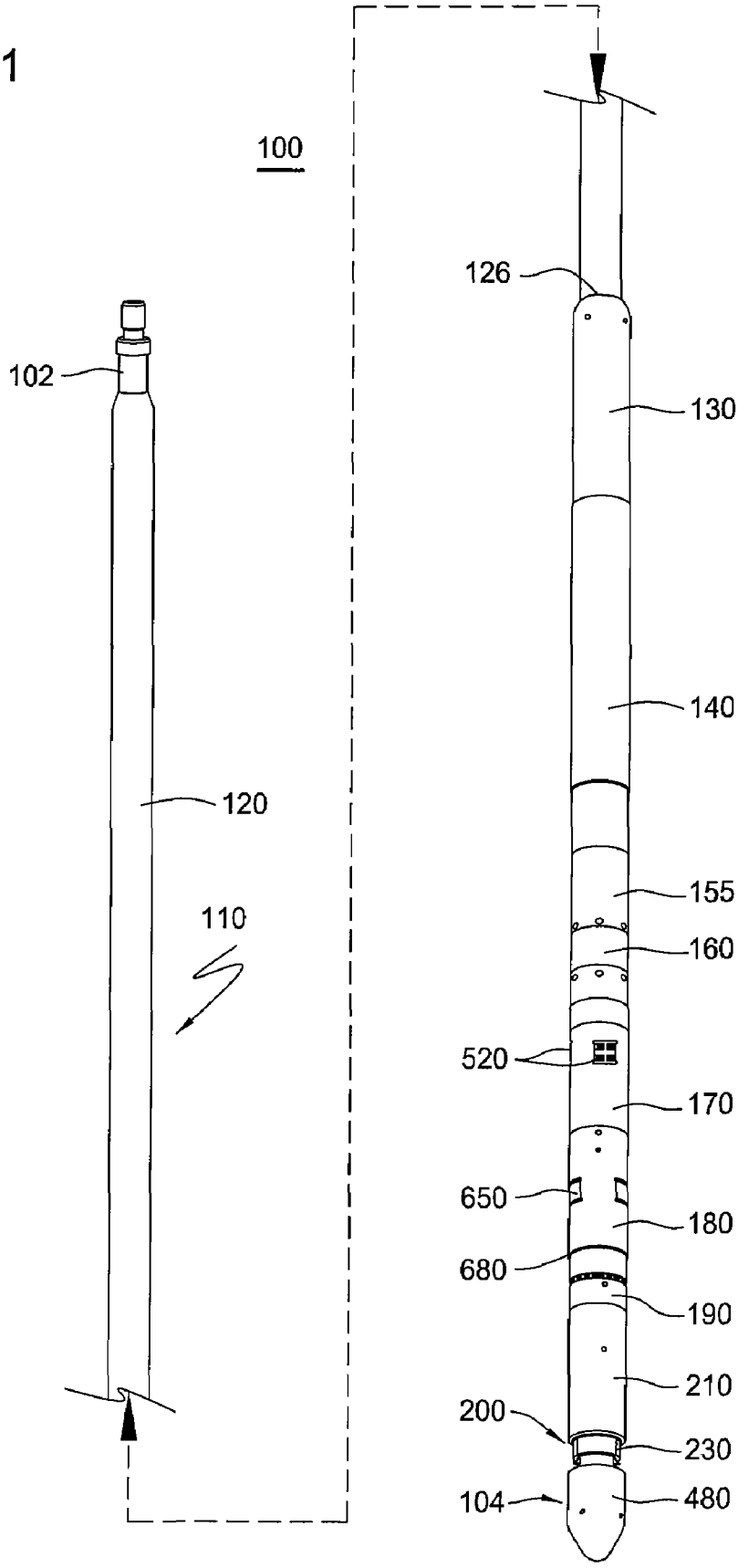
FIG. 1 presents a side elevational view of a milling tool of the present invention, in one embodiment. The milling tool is shown in its run-in position.

FIG. 1 presents a side elevational view of the milling tool 100 of the present invention, in one embodiment. The milling tool 100 is shown in its run-in position. It can be seen that the milling tool 100 is an elongated tool that is configured to be deployed in a wellbore. In one use, the milling tool 100 is landed within the housing of a tubing-retrievable subsurface safety valve (TRSSV) (not shown in FIG. 1). In this respect, the milling tool 100 provides an outer no-go shoulder 680 that lands on a matching beveled inner shoulder of the TRSSV.

As will be described fully herein, the purpose of the milling tool 100 is to form an opening in the housing of a downhole tubular. In the example presented herein, the downhole tubular defines a tubing-retrievable safety valve. However, it is understood that the milling tool 100 may be used to mechanically form an opening in any downhole tubular body. In addition, the present invention will be described in connection with a tubing retrievable surface controlled subsurface flapper type safety valve, where it is operationally desirable to establish hydraulic communication with a slickline inset valve. It will be understood that the present invention may be used with other types of subsurface safety valves, including those having different type valve closure members such as balls, and those having different type actuation methods, such as subsurface controlled (i.e., velocity, dome charged, and injection) safety valves.

As will be shown, the milling tool 100 of the present invention comprises a housing system, a cutting system, a drive system, and an actuation system. Optionally, the tool 100 also provides an anchoring system for anchoring the tool housing 110 within a surrounding valve housing 52 so as to prevent rotation of the tool housing 110 during tool 100 actuation. Further, the tool 100 includes optional locating means for providing a more precise ability to locate the milling tool 100 at a desired location within the subsurface safety valve 50. These various systems are described and numbered below in connection with the cross-sectional views of the milling tool 100.

As noted above, the milling tool 100 first comprises a housing system 110. As shown in the isometric view of FIGS. 1 and 2, the housing system 110 generally runs the length of the tool 100. In the arrangement of FIG. 1, the housing system 110 is made up of a series of tubular sub-housings, generally connected end-to-end. However, the sub-housings are preferably configured to permit some telescopic compression of the housing system 110 incident to tool 100 actuation. More specifically, a sliding sleeve 155 is provided along the housing 110 to permit telescopic collapse.

The tool 100 has an upper end 102 and a lower end 104. The upper end 102 serves as a connector to a run-in tool. The run-in tool may be for example, a slickline or a string of coiled tubing. In one aspect, the upper end 102 connects to a slickline stem used in connection with oil field jars, such as spang jars (not shown). The jars are used to hammer downwardly upon a tool within the wellbore by alternately raising the slickline and a connected weighted wire line stem, and dropping the slickline and connected weighted wire line stem upon a steel bar.

The first sub-housing is seen near the upper end 102 of the tool 100. This sub-housing is a thermal housing 120. The thermal housing 120 defines an elongated tubular body. The upper end of the thermal housing 120 is the connector 102 described above. In the preferred arrangement, the thermal housing 120 serves as a housing for certain components for the milling apparatus 100.

The next housing is a motor housing 130. The motor housing 130 is disposed immediately below the thermal housing 120. The motor housing 130 is connected to the thermal housing 120 by a flask connector 126. The configuration and purpose of the flask connector 126 will be described in greater detail below, in connection with FIGS. 4A(1)-A(2).

Below the motor housing 130 is a series of additional sub-housings. These include a switch housing 140, a hook body housing 160, a button housing 170, a no-go body housing 180, a shear pin housing 190 and a cutter head housing 210. Intermediate the switch housing 140 and the hook body housing 160 is a sliding sleeve 155. The sliding sleeve 155 receives the switch housing 140 when the tool 100 is actuated, permitting some telescopic collapsing of the tool 100 along its length.

Figure 2:
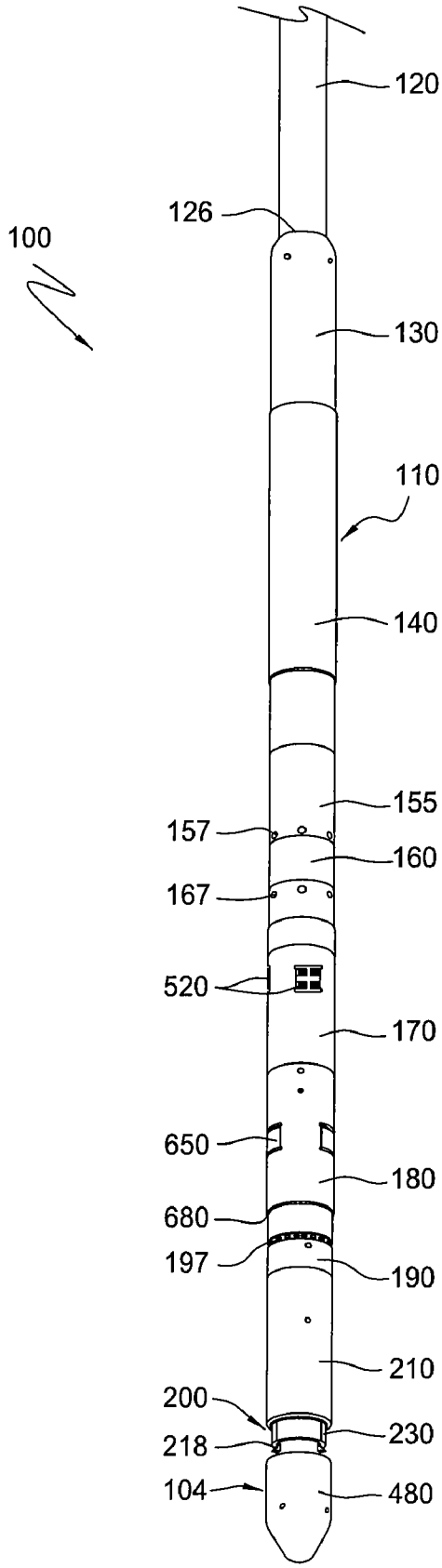
FIG. 2 presents an enlarged isometric view of the lower portion of the tool of FIG. 2. More visible in this view are a plurality of sub-housings that comprise the housing system for the milling apparatus. A no-go shoulder is specifically seen along the length of the housing system for locating within the inner diameter of a primary valve, e.g., tubing-retrievable safety valve.

The configuration of the housing system 110 for the tool 100 is seen in greater detail in FIG. 2. FIG. 2 presents an enlarged perspective view of the tool 100 of FIG. 1, from the flask connector 126 down. Seen more clearly in FIG. 2 are various sub-housings, i.e., the motor housing 130, the switch housing 140, the sliding sleeve 155, the hook body housing 160, the button housing 170, the no-go body housing 180, the shear pin housing 190, and the cutter head housing 210. These sub-housings are generally stationary relative to one another, with the exception of the telescopic movement permitted by the sliding sleeve 155. In this respect, the thermal housing 120, the motor housing 130 and the switch housing 140 move downwardly relative to the sliding sleeve 155 and sub-housings 160, 170, 180, 190 and 210 there below.

FIG. 2 also shows a no-go shoulder 680 formed along the housing 110. In the views of FIGS. 1 and 2, the no-go shoulder 680 is placed on the outer surface of the no-go body housing 180. The no-go shoulder 680 is provided to locate the tool 100 properly within the inner diameter of the primary valve, e.g., tubing-retrievable safety valve (seen partially at 50 in FIG. 4A(2)). The no-go shoulder 680 is configured to land into a matching beveled shoulder of the TRSVV 50.

A set of buttons 520 is also seen along the housing 110. The buttons 520 are more specifically disposed along the button housing 170. As will be shown in connection with FIGS. 4A(2) and 4D, the buttons 520 are urged outwardly from the button housing 170 after the tool 100 is landed within the TRSSV 50. The buttons 520 will engage the surrounding TRSSV 50 body in order to serve as a torque anchor while the milling operation is being performed.

Also visible in FIG. 2 is a set of milling blades 218. The milling blades 218 are part of the cutting system 200 for the present invention. The blades 218 are disposed along a cutter body 480, and are rotated when the tool 100 is actuated. As will be discussed in greater detail in connection with the operational figures that follow, the cutter body 480 and attached blades 218 are rotated via a shaft system 400 (shown in FIG. 3A(1)) connected to the rotary motor 310 (also shown in FIG. 3A(1)).

FIG. 2 also shows a set of locating dogs 650 disposed along the no-go body housing 180. The locating dogs 650 aide in properly locating the tool 100 before the milling operation takes place. As will be shown below, the locating dogs 650 pop outwardly into a recess (shown at 53 in FIG. 4A(2)) of the surrounding tubing-retrieval subsurface safety valve 50.

Finally, two sets of screws 157, 167 are seen along the housing 110 in FIG. 2. A first set of screws 157 connects the sliding sleeve 155 to the hook body housing 160; a second set of screws 167 connects the hook body housing 160 to the button housing 170. Thus, movement between the sliding sleeve 155, the hood body housing 160 and the button housing 170 is fixed.

FIGS. 3A(1)-A(2) present a cross-sectional view of the milling apparatus 100 of FIG. 1. First, a cross-sectional view of the thermal housing 120 is seen in FIG. 3A(1). Visible within the thermal housing 120 are a plurality of batteries 315 for operating a motor 310 within the tool 100, and a controller 320 for controlling the motor 310. The drive system 300 and actuation system 330 are also seen in this view. An electrical connector 318 for providing electrical communication between the batteries 315, the actuating system 330 and the drive system 300 is also shown.

One of ordinary skill in the art will recognize the temperature-sensitive nature of the controller 320. For this reason, the controller 320 and connected batteries 315 are housed within a thermal housing 120. The thermal housing 120 is manufactured as a Dewar flask to house the controller 320, meaning that it is constructed from concentric metal tubes having a vacuum therebetween. The vacated space may be filled with a non-thermally conductive powder or other material to mechanically support the tubes. In one aspect, a Teflon-filled material is used in the vacated space to provide a ruggedized insulator. The controller 320 can thus be immersed into an environment of 300° F. for an extended period of time without thermal damage to the controller 320 or batteries 315.

It should be noted that a plurality of batteries 315 are presented in FIG. 3. Additional batteries 315 provide additional power in order to drive the motor 310 of the drive system 300. In one aspect, the batteries are nickel cadmium batteries disposed in series within the thermal housing 120.

Moving now to FIGS. 4A(1)-A(2), FIGS. 4A(1)-A(2) provide a cross-sectional view of a portion of the milling tool 100 of FIG. 3A(1)-A(2), in its run-in position. The tool 100 is only seen from the flask connector 126, down. In FIG. 4A(2), the milling tool 100 has been landed within the housing 52 of a tubing-retrievable safety valve 50. More specifically, the no-go shoulder 680 on the outer surface of the no-go body housing 180 has landed on the beveled shoulder within the valve housing 52.

In FIGS. 4A(1)-A(2), the actuating system 330 has not been initiated. For this reason, the drive system 300 is not driving the shaft system 400 in order to turn the blades 218 of the cutting system 200. These steps will be described incrementally in connection with FIGS. 5A(1) through 9A(2). In one or two instances, tool parts are shaded in these views in order to indicate energized or moving parts.

Visible first in FIG. 4A(1) is a connector 126. The connector 126 is a threaded neck at the top end 132 of the motor housing 130. The connector 126 serves to mechanically connect the lower end of the thermal housing 124 with the upper end of the motor housing 132. The connector 126 includes seals 127 disposed along an outer surface. The seals 127 in one arrangement are O-rings. The seals 127 provide a fluid seal between the thermal housing 120 and the connector 126, effectively making a seal between the ID of the thermal housing 120 and the wellbore. A separate seal (not shown) may be used to create a seal between the connector 120 and the motor housing 130. Thus, the connector 126 makes a seal between the motor housing 130, the thermal housing 120, and the surrounding wellbore.

A connector retainer 128 is also seen in FIG. 4A(1). The connector retainer 128 resides within the connector 126. The connector retainer 128 assists in retaining the electrical connector 318 against wellbore pressure. A snap ring 129 may also be used to assist in retaining the connector retainer 128.

The connector 126 houses an electrical connector 318 having electrical pins 316 on opposite ends thereof. In one arrangement, the electrical connector 318 is a 10-pin hermaphroditic connector. At one end, the electrical connector 318 receives a reciprocal connector from the thermal housing 120 in order to provide electrical communication with the batteries 315 and the controller 320. At an opposite end, the electrical connector 318 receives wires 317 that provide electrical communication with the motor 310 and the actuating system 330.

Below the connector 126 is the connected motor housing 130. The motor housing 130 defines an elongated tubular body having a top end 132 and a bottom end 134. As the name implies, the motor housing 130 houses the motor 310 of the drive system 300. In one aspect, the motor 310 defines a brushless DC powered rotary motor. In one aspect, electrical power is supplied from THE stack of NiCad batteries 315 that are housed within the thermal housing 120. The motor 310 is shown somewhat schematically in FIG. 4A(1).

However, it is understood that the motor 310 includes a stationary outer housing and a rotating shaft. Rotation of the shaft is controlled through the controller 320. The controller 320 is a sensorless microprocessor having software that serves to control the alternating electromagnetic field necessary through three-phase DC power to drive a rotating output shaft 410.

The motor 310 is connected to a gear box 312. Where a high RPM electric motor is used, a gearbox is employed to reduce the RPMs. The gear box 312, in turn, is connected to the output shaft 410, which becomes part of the shaft system 400. As will be described, the shaft system 400 connects the motor 310 to the cutting system 200, e.g., cutter body 480.

The motor housing 130 includes a cavity area 136 between the housing 130 and the motor 310 itself. The cavity area 136 is optionally filled with a dielectric fluid, such as silicon oil. As will be described below, the dielectric fluid is generally pressurized to wellbore pressure. A lower portion of the motor housing cavity 136 includes a switch 330. In the preferred arrangement for the actuating system 330, the switch forms an integral part of the actuating system 330. Hence, the two parts share a reference number. In one aspect, the switch 330 defines a reed switch which is magnetically sensitive. As will be discussed further below, the switch 330 closes when it comes into proximity with a magnetic force, such as a magnet (shown at 332). This will serve to close the circuit for the electrical circuitry of the drive system 300, allowing electrical current to flow through the wires 317 in order to actuate the drive system 300 for the tool 100. In one aspect, the reed switch 330 is potted into the cavity 136 using a flexible epoxy potting compound Below the motor housing 130 is a switch housing 140. The switch housing 140 also has an upper end 142 and a lower end 144. The top end 142 of the switch housing 140 is threadedly connected to the bottom end 134 of the motor housing 130. The switch housing 140 has an inner bore for receiving a drive shaft 420. The drive shaft 420 is driven by the output shaft 410 from the motor 310 and gear box 312. The switch housing 140 also has a pair of cavities 146, 148. The first cavity 146 houses a pressure balancing piston 145, while the second cavity 148 receives a rod 340.

Figure 4B:
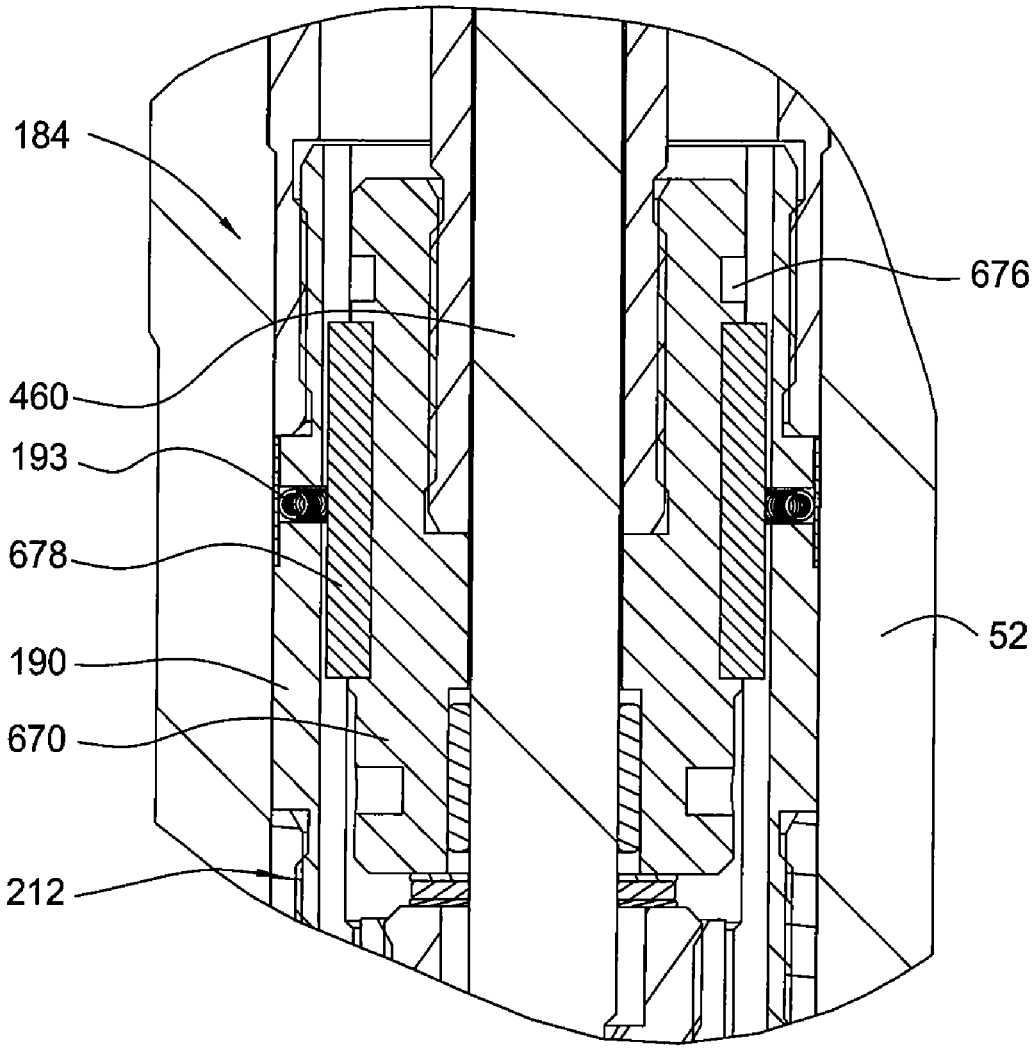
FIG. 4B shows a cross-sectional view of a portion of the milling tool of FIG. 4A(2). The view is taken across line B-B of FIG. 4A(2) in order to show a transverse portion of the tool. More specifically, keys are visible to rotationally lock the cutter mandrel head to the pin housing.
Figure 4C:
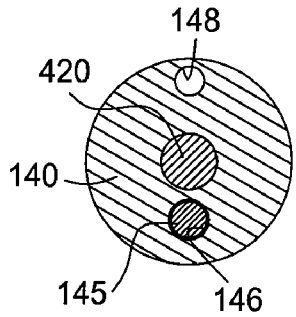
FIG. 4C provides a cross-sectional view of the tool of FIG. 4A(1), with the view being cut through line C-C. Line C-C is cut through the switch housing. Visible in this view are first and second cavities residing within the switch housing. A pressure balancing piston is seen within the first cavity. A rod slidably resides within the second cavity, but is not seen in this view.

FIG. 4C shows a cross-sectional view of the milling tool 100 of FIG. 4A(1), with the view being taken across line C-C. Line C-C is cut through the switch housing 140. Visible in this view are the first 146 and second 148 cavities within the switch housing 140. The pressure balancing piston 145 is seen within the first cavity 146. However, the rod 340 that slidably resides within the second cavity 148 is not seen in this view.

The first cavity 146 is in fluid communication with the annular region 136 of the motor housing 130. Thus, the first cavity 146 of the switch housing 140 is also filled with a dielectric fluid. The fluid is placed above the pressure balancing piston 145. Again, the dielectric fluid is a non-conductive type fluid, such as silicon oil. The portion of the first cavity 146 opposite the pressure balancing piston 145 is exposed to wellbore pressure. Thus, the piston 145 serves to pressure balance the inside of the housing 110 around the flask connector 126, while preventing caustic wellbore fluids from contacting the motor 310 and connected hardware, e.g., gear box 312. The floating piston 145 also compensates for temperature increases of the dielectric fluid caused by downhole conditions, and by heat dissipated by the motor 310. This ensures that there is no differential pressure acting on the sealed shaft o-ring so that the motor 310 does not have to overcome increased drag caused by the differential.

As noted, the second cavity 148 for the switch housing 140 houses a rod 340. The rod 340 defines an elongated rod having an upper end 342 and a lower end 344. The upper end 342 includes a strong permanent magnet 332. Thus, the rod 340 and magnet 332 form a part of the actuating system 330. The lower end 344 defines a hook. As will be described below, the hook 344 connects to a hook body housing 160.

As with the balancing piston 145 within the first cavity 146, the rod 340 within the second switch housing cavity 148 is moveable. In this respect, when the milling tool 100 is landed into the primary safety valve 50, force is applied downward along the thermal housing 120, motor housing 130, and switch housing 140 of the tool 100. As will become clearer from the additional description of the tool 100 below, this serves to telescopically collapse the housing 110, causing the rod 340 to move upward within the second cavity 148 of the switch housing 140. As the rod 340 moves axially upward within the switch housing 140, it approaches the reed switch 330 within the cavity 136 of the motor housing 130. The reed switch 330 closes the electrical circuitry of the drive system 300, allowing current from the batteries 315 and the controller 320 through the electrical connector 318, via wires 317, and to the motor 310.

As a safeguard, an interlocking means may be designed into the actuating system 330. For example, a timer may be incorporated into the software for the controller 320 in order to require a delay, such as a delay of 5 minutes, after the reed switch 330 closes the circuit. Other safeguards may be build into the system as well. For example, a temperature sensor may be exposed along the length of the housing 110. The temperature sensor reads downhole temperature as the tool 100 is lowered into the wellbore. The controller 320 would then include electronics that monitor temperature readings. In one aspect, a temperature reading of at least 300° would be required before the motor 310 is actuated.

Other interlocking features may be included within the tool 100 as well. These include motion sensors and pressure sensors. For example, an optional accelerometer pack (not shown) can be wired in series with the reed switch 330 for added assurance that the controller 320 will not receive an enable signal until the reed switch 330 is closed and the entire tool 100 has come to rest. Such features again serve to prevent premature actuation of the drive system 300 and attached cutting system 200 for the tool 100.

Returning now to FIG. 4A(1), it can be seen from FIG. 4A(1) that the lower end 344 of the rod 340 extends to the depth of the sliding sleeve 155. The rod 340 is moveable within the sliding sleeve 155. The sleeve 155 is dimensioned not only to receive the rod 340, but also to slideably receive the switch housing 140 when the milling tool 100 is run into the wellbore and landed into the TRSSV 50.

The housing system 110 next comprises a hook body housing 160. The hook body housing 160 also comprises an upper end 162 (seen in FIG. 4A(1)) and a lower end 164 (seen in FIG. 4A(2)). The upper end 162 of the hook body housing 160 is connected to the lower end 344 of the rod 340. The hook body housing 160 is also connected to the sliding sleeve 155. In the arrangement in FIG. 4A(1), a set of screws 157 are used to provide a mechanical connection. When the milling tool 100 is run into the wellbore and landed into the TRSSV 50, and as downward jarring occurs to the tool 100, the switch housing 140 is slidably received within the sliding sleeve 155. Also, as noted above, the rod 340 is driven upward within the second cavity 148 of the switch housing 140.

The housing system 110 for the tool 100 next comprises a button housing 170. The button housing also comprises a top end 172 and a bottom end 174. In the arrangement of FIG. 4A(2), the top end 172 of the button housing 170 is connected to the hook body housing 160. Connection is a mechanical connection via a plurality of screws 167. Thus, relative movement between the button housing 170 and the hook body housing 160 is fixed.

As noted, the milling tool 100 includes an optional anchoring means 500. In one aspect, the anchoring means 500 comprises a plurality of cones 510 and a plurality of matching buttons 520. In the arrangement of FIG. 4A(2), the cones 510 are immediately disposed below the lower end 164 of the hook body housing 160. When downward force is transmitted to the tool 100, a load ring 616 below the hook body housing 160 contacts the cones 510 to drive them downward. Each of the cones 510 includes a beveled lower shoulder 514 that rides under an upper beveled shoulder 522 of the respective buttons 520. This serves to urge the buttons 520 outward and into contact with the surrounding housing 52 of the valve 50. The buttons 520 include teeth 526 that bite into the housing 52 of the valve 50. In this manner, relative rotation of the tool housing 110 to the valve 50 is prohibited.

The button housing 170 includes a plurality of recesses 176. A recess 176 is seen best in FIG. 3A(2). The recesses 176 receive buttons 520. The recesses 176 are configured to permit the buttons 520 to move radially outward through the button housing 170 when acted upon by the cones 510. The cones 510 include a sliding dove-tail connection with the respective buttons 520. In this manner relative rotation of the cones 510 to the buttons 520 is prohibited. Further, any upward force to the cones 510 will cause the buttons 520 to recede inward, i.e., back into the recesses 176.

Figure 4D:
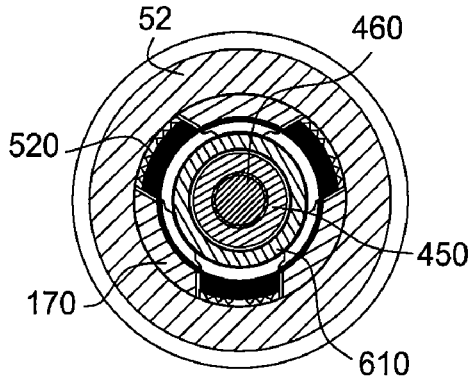
FIG. 4D shows yet another cross-sectional view of the tool of FIG. 4A(2). Here the view is taken across line D-D. The bottom of a plurality of buttons are seen, residing within a button housing.

FIG. 4D shows a cross-sectional view of the tool of FIG. 4A(2), with the view being taken across line D-D. The bottom of a plurality of buttons 176 are seen, residing within button housings 176.

The housing system 110 for the tool 100 next comprises a no-go body housing 180. The no-go body housing 180 has an upper end 182 that is threadedly connected with the lower end 174 of the button housing. The no-go body housing 180 further has a lower end 184. As with other sub-housings, the no-go body housing 180 defines a tubular body. The no-go body housing 180 has a profiled outer surface. The profiled outer surface becomes a part of the locating means 600 for the tool 100. More specifically, a no-go shoulder 680 is formed on the outer surface of the no-go body housing 180. As described above, the no-go shoulder 680 serves as a locator for landing into a matching shoulder along the inner surface of the housing 52 for the surrounding TRSSV 50.

As with the button housing 170, the no-go body housing 180 also has a plurality of recesses 186. The no-go body housing recesses 186 are configured to receive respective locating dogs 650. The locating dogs 650 are also part of the locating means 600 for the tool 100. When the milling tool 100 is landed within the TRSSV 50, and as downward force is transmitted through the tool 100, the locating dogs 650 are urged outwardly from the recesses 186 of the no-go body housing 180 into a corresponding radial recess 53 within the valve housing 52. This process will be described in additional detail below.

Figure 4E:
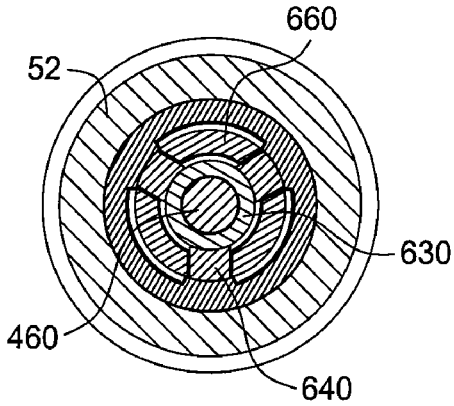
FIG. 4E shows an additional cross-sectional view of FIG. 4A(2), seen through line E-E. This view more clearly shows the radial placement of locking dogs along a locating mandrel. In this view, the locking dogs temporarily lock the locating mandrel to a cutting mandrel. The locking dogs are constrained by the inner diameter of a no-go body housing.
Figure 4F:
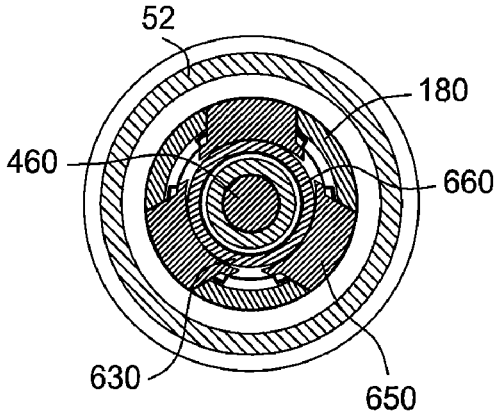
FIG. 4F is provided to show a cross-sectional view of the milling tool of FIG. 4A(2), through line F-F. Visible in this view are locating dogs also radially disposed about the locating mandrel. The locating dogs are residing closely to the locating mandrel, and have not yet popped outwardly.

FIG. 4F is provided to show a cross-sectional view of the milling tool 100 of FIG. 4A(2), through line F-F. Visible in this view are locating dogs 650 radially disposed about a locating mandrel 660, and within the no-go body housing 180. The locating dogs 650 are residing closely to the locating mandrel 660, and have not yet popped outwardly.

The housing system 110 for the milling tool 100 next comprises a shear pin housing 190. The shear pin housing 190 is connected to the lower end 184 of the no-go body housing 180. As the name implies, the shear pin housing 190 houses a plurality of shear pins 197. The shear pins 197 are received within respective radially disposed recesses 196 of the shear pin housing. The shear pins 197 are further held within the respective recesses 196 by one or more garter springs 193. In this manner, the pins 197 are biased to more inward within the recesses 196. The inward movement of the shear pins 197 will be described in additional detail below.

The housing system 110 for the milling tool 100 next comprises a cutter head housing 210. The cutter head housing 210 has a top end 212 and a lower end. The top end 212 of the cutter head housing 210 is connected to the shear pin housing 190 opposite the no-go body housing 180. The cutter head housing 210 is dimensioned to receive an elongated release sleeve 230. The release sleeve 230 is a part of the cutting system 200 for the tool 100. The cutter head housing 210 has an inner surface which is threaded. Likewise, the release sleeve 230 has an outer surface that is threaded. As will be described in additional detail below, the release sleeve 230 is driven upward within the cutter head housing 210 along the matching threads when the drive shaft system 400 and connected release sleeve 230 are rotated within the cutter head housing 210.

As noted above, the housing system 110 for the milling tool 100 is dimensioned to receive the motor 310 and connected shaft system 400 for the tool 100. The motor 310 and gear box 312 serve to transmit torque to the shaft system 400. The shaft system 400, in turn, serves to transmit torque to the cutting means 200 for the tool 100. This is accomplished in the following manner.

First, the gear box 312 has a connected output shaft 410. The output shaft 410, in turn, is connected to one or more additional shafts. In the arrangement of FIG. 4A(1), an elongated drive shaft 420 is provided below the output shaft 410. The drive shaft 420 is housed within the switch housing 140. In one aspect, the drive shaft 420 includes a slideable connection within a drive shaft receptacle 422. Splines are seen along the drive shaft receptacle 422. In the arrangement of FIG. 4A(2), the drive shaft 420 is connected at one end to an upper drive shaft extension 430 which, in turn, is connected to a lower drive shaft extension 440. The upper 430 and lower 440 drive shaft extensions are seen best in FIG. 3A(2).

The lower end 144 of the switch housing 140 is threadedly connected to a bearing housing 150. As the name indicates, the bearing housing 150 houses a bearing system that permits the shaft 400 to rotate. In one aspect, the bearings include a needle roller bearing 432 and a pair of needle thrust bearings 434. The needle roller bearings 432 serve to take up side load, while the needle thrust bearings 434 take up axial load. The needle roller bearings 432 and the needle thrust bearing 434 reside between the bearing housing 150 and the shaft 400. At this level, the shaft 400 defines an upper drive shaft extension 430. Thus, the upper drive shaft extension 430 is connected to a lower end of the drive shaft 420.

Below the lower drive shaft extension 440, a head cap 450 is provided. The head cap 450 has an upper end 452 and a lower end 454 (shown in FIG. 3A(2)). The upper end of the head cap 452 receives the lower drive shaft extension 440. The lower end 454 of the head cap 450 receives a second elongated shaft 460, referred to as a cutting head drive shaft.

As will be described below, the cutting head drive shaft 460 extends into the cutter body 480 in order to rotate blades 218 of the cutting system 200.

The shaft system 400 for the tool 100 finally comprises a spring shaft 470. The spring shaft 470 connects the cutting head drive shaft 460 to the cutter body 480 by a pair of threaded connections. The spring shaft 470 is disposed within a biasing spring 476. The action of the biasing spring 476 will be described in additional detail below.

As noted above, the milling tool 100 of the present invention also comprises a cutting system 200. The cutting system 200 of the present invention presents a novel means for forming an opening within the housing 52 of a tubing-retrievable safety valve 50. More specifically, a mechanical way for providing fluid communication between the hydraulic fluid system of the TRSSV at a precise location of the inner bore of the valve 50 is provided. Heretofore, a means for providing such a precision cut has been unknown in the art.

The cutting system 200 is rotated by the drive system 300. In this respect, the cutter body 480 of the cutting system 200 is connected to the shaft system 400. The cutter body 480 as seen in FIG. 3A(2), has an upper portion 482 which is generally tubular in configuration. A lower portion 484 of the cutter body 480 defines a generally solid piece having a hexagonal recess 486. The hexagonal recess 486 is provided for assembly purposes, and receives a tool (not shown such as an Allen wrench during assembly).

Intermediate the upper 482 and lower 484 portions of the cutter body 480 is one or more blades 218. In the arrangement of FIG. 4A(2), the blades 218 are disposed at the lower end of respective cam lobes 202. The cam lobes 202 pivot about respective hinges 216. When a downward force is applied against the top of the cam lobes 202 from within the upper tubular portion 482 of the cutter body 480, the blades 218 are pivoted outwards away from the housing 110 of the tool. In this manner, the blades 218 are able to contact the inner surface of the housing 52 for the safety valve 50.

The blades 218 are biased to move outward. In order to drive the blades 218 outward, a downward force is applied to the lobes 202 of the blades 218. To provide the desired downward force, a choke pin 220 is first provided. The choke pin 220 resides within a choke box 215. The choke box 215 has an upper end 214 that is in contact with the biasing spring 240, mentioned earlier. The spring 240 biases the choke box 215 to act downwardly. The choke box 215, in turn, is able to act downwardly on the choke pin 220, causing the blades 218 to pivot about their respective hinges 216.

It should be noted that the configuration of the choke pin 220 within the choke box 215 provides a unique means for adjusting the degree to which the cam lobes 202 are flanged outward. In this respect, the choke pin 220 is threadedly inserted into the choke box 215. The farther the choke pin 220 is inserted into the choke box 215, the less the cam lobes 202 and attached blades 218 are flanged out.

In the run-in position shown in FIG. 4A(2), the blades 218 of the cutting system 200 are recessed within the housing 110 of the tool 100. More specifically, the blades 218 are retained within the release sleeve 230, described above. A lower end 234 of the release sleeve 230 extends downward and adjacent to the blades 218 of the cutting system 200. However, when the actuating system 300 for the tool 100 is actuated, the release sleeve 230 is driven upward within the cutter head housing 210, allowing the blades 218 to be freed from the restraining release sleeve 230 and to pivot outward towards the TRSSV 50.

The cutter head housing 210 includes a keyway 213 running along its length. The keyway 213 receives a spline (not shown) within the release sleeve 230. The release sleeve 230 rotates within the cutter head housing 210 when the actuating system 300 of the tool 100 is actuated. The release sleeve 230 rides upward within the cutter head housing 210, and along the keyway 213. In this manner, the release sleeve 230 is able to back away from the blades 218 of the cutting system 200.

Figure 4G:
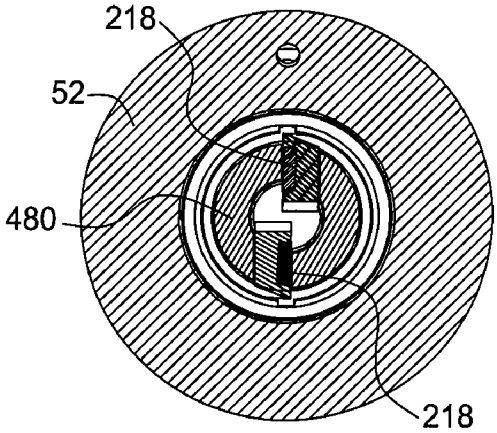
FIG. 4G shows a final cross-sectional view of the milling tool of FIG. 4A.

FIG. 4G shows an additional cross-sectional view of the milling tool 100 of FIG. 4A. FIG. 4G is cut across line G-G of FIG. 4A. The view is cut through the blades 218 for the actuating system 200 of the tool 100. The blades 218 have not yet been rotated, but are held within the longitudinal access of the tool 100 by the tubular release sleeve 230.

At the lower end 104 of the milling tool 100, an optional junk basket 700 is provided. The junk basket 700 has a nose 704 at a lower end. An upper end 702 of the junk basket receives the lower portion 484 of the cutter body. Sufficient space is provided between the upper portion 702 of the junk basket and the lower portion 484 of the cutter body 480 in order to define a receptacle. As metal shavings are taken from the inner bore of the safety valve 50, the shavings fall into the receptacle 702 formed by the upper portion of the junk basket 700. In this manner, metal shavings can be cleaned from the wellbore after the tool 100 is pulled. An optional magnet (not shown) may be included within the receptacle 702.

The milling tool 100 in the present invention also comprises locating features 500. The no-go shoulder 680 along the no-go body housing 180 has already been described. This feature is desirable to provide the most precise placement of the cutting blades 218 within the safety valve housing 52. However, additional features may also be provided.

First, a series of mandrels 610, 630, 660 are provided. Each mandrel 610, 630, 660 defines a tubular body having a top end and a bottom end. Further, each mandrel 610, 630, 660 is nested between the housing system 110 and the shaft system 400 for the tool 100.

The first mandrel is the setting mandrel 610 (seen in FIGS. 3A(2) and 4A(2)). The setting mandrel 610 has an upper end 612 and a lower end 614. The upper end 612 of the setting mandrel 610 is connected to the bearing housing 150 opposite the switch housing 140. From there, the setting mandrel 610 extends down below the cones 510 and the buttons 520. The outer diameter of the setting mandrel 610 constrains the cones 510 from moving into the button housing 170. The bottom end 614 of the setting mandrel 610 is disposed adjacent the top end of the cutter mandrel 630. As will be described in further detail below, the setting mandrel 610 moves downward relative to the cutter mandrel 630 as additional downward force is transmitted through the tool 100.

In the run-in position for the tool 100, the setting mandrel 610 is disposed generally within the hook body housing 160 and the button housing 170. Further, the setting mandrel 610 is generally disposed around the lower drive shaft extension 440 and the head cap 450. Of interest, a load ring 616 is placed on the outer surface of the setting mandrel 610 above the cones 510. The load ring 616 will act downwardly on the cones 510 when downward force is transmitted through the tool 100.

The second mandrel of the tool 100 is the cutter mandrel 630. The cutter mandrel 630 has an upper end 632 (numbered in FIG. 3A(2)) and a lower end 634 (numbered in FIG. 4A(2)). The upper end 632 has an outer surface which includes ratcheting teeth. A ratchet 620 is disposed around the upper end 632 of the cutter mandrel 630, and ratchets downward along the teeth of the cutter mandrel 630 when downward force is transmitted through the tool 100. The lower end 614 of the setting mandrel 610 actually shoulders out against the top of the ratchet 620. Thus, when the setting mandrel 610 moves downward, the setting mandrel 610 drives the ratchet 620 downward along the teeth of the cutter mandrel 630. The ratcheting arrangement is important in order to maintain the outward force on the buttons 520.

Finally, the third mandrel is a locating mandrel 660. The locating mandrel 660 is disposed around the outer surface of the cutter mandrel 630. The locating mandrel 660 carries the ratchet 620. In addition, the locating mandrel 660 carries a plurality of locking dogs 640.

FIG. 4E shows yet another cross-sectional view of FIG. 4A(2), seen through line E-E. This view more clearly shows the radial placement of locking dogs 640 along the locating mandrel 660. In this view, the locking dogs 640 lock the locating mandrel 660 to the cutter mandrel 630 temporarily. The locking dogs 640 are constrained by the inner diameter of the no-go body housing 180.

The locating mandrel 660 receives one or more shear pins 662. It can be seen in the view of FIG. 4A(A)(2) that the shear pin 662 is connecting the no-go body housing 180 to the locating mandrel 660. Thus, a temporary connection is made between the locating mandrel 660 and the surrounding no-go body housing 180. The shear pin 662 serves to prevent premature downward movement of the setting mandrel 610, the locating mandrel 660, and the attached ratchet 620 and locking dogs 650.

An additional tool is seen disposed along the lower end 634 of the cutter mandrel 630. This is a cutter mandrel head 670. The cutter mandrel head 670 extends below the cutter mandrel 630, and resides between the cutting head drive shaft 460 and the surrounding shear pin housing 190. A needle roller bearing 672 and needle thrust bearings 674 (numbered in FIG. 3A(2)) are seen adjacent the cutter mandrel head 670 to permit rotational movement relative to both the inner cutting head drive shaft 460 and the below spring shaft 470.

It should be noted that the cutter mandrel head 670 does not rotate relative to the shear pin housing 190. To this end, a keyed connection is provided between the cutter mandrel head 670 and the shear pin housing 190. FIG. 4B shows a cross-sectional view of a portion of the milling tool 100 of FIG. 4A(2). The view is taken across line B-B of FIG. 4A(2) in order to show a transverse portion of the tool 100 proximate the cutter mandrel head 670. More specifically, keys 678 are visible to rotationally lock the cutter mandrel head 670 to the pin housing 190.

It is also noted that the cutter mandrel head 670 has a plurality of recesses 676. It will be noted later in FIG. 6A(2), that the shear pins 197 will move into the recesses 676 of the cutter mandrel head 670 when the tool 100 is actuated. This will further hold to serve the cutting blades 218 in their precise location for cutting in accordance with the locating system 600 for the present invention 100.

An optional backlash system 800 is finally provided for the milling tool 100 of the present invention. The backlash system 800 serves to absorb the impact of the tool 100 as the tool 100 is landed in the tubing-retrievable safety valve 50, and as the tool 100 is otherwise jarred in place. First, a plurality of wave washers 802 are loaded into the tool 100 below the bearing housing 150. It can be seen from FIG. 3A(2) and FIG. 4A(2) that two sets of wave washers 802 are provided. One or more flat washers 804 is disposed immediately above each set of wave washers 802. As will be shown in FIG. 6A(2), the wave washers 802 will absorb shock between the load rings 616 and the lower end 154 of the bearing housing as the bearing housing 150 moves downward. More specifically, the lower end 154 of the bearing housing will transmit downward force through the load ring 616 against the cones 510 and adjacent buttons 520. A shoulder 156 in the bearing housing 150 also acts downwardly against the top end 612 of the setting mandrel 610.

Moving now to FIGS. 5A(1)-A(2), FIGS. 5A(1)-A(2) present a new cross sectional view of the milling tool 100 of FIGS. 4A(1)-A(2). This view shows the tool 100 in a second position. The milling tool 100 remains landed within the housing 52 of the tubing-retrievable valve 50. Downward force is now being applied through the housing system 110 of the tool 100.

First, it can be seen that shear pin 662 temporarily connecting the no-go body housing 180 to the locating mandrel 660 has been sheared. Shearing takes place in response to the jarring down action on the tool 100. Shearing of the pin 662 allows the locating mandrel 660 to move downward relative to the housing system 110 of the milling apparatus 100. As the locating mandrel 660 shifts downward, it pushes the attached locating dogs 650 downward. In FIG. 5A(2), it can be seen that the locating dogs 650 have popped outward towards the recess 53 within the valve housing 52. In this respect, the locating mandrel 660 has a downward facing shoulder 668 that matches against an upward facing shoulder 658 on the locating dogs 650. Thus, downward force by the locating mandrel 660 against the locating dogs 650 not only urges the locating dogs 650 downward, but outward as well.

In FIG. 5A(2), the shoulder 668 of the locating mandrel 660 has acted against the locating dogs 650, pushing them outward. The shoulder 668 has now moved below the locating dogs 650. When the locating dogs 650 move outward into the valve housing recess 53, the inner bore of the no-go body housing 180 is cleared for further downward movement of the locating mandrel 660.

Figure 5H:
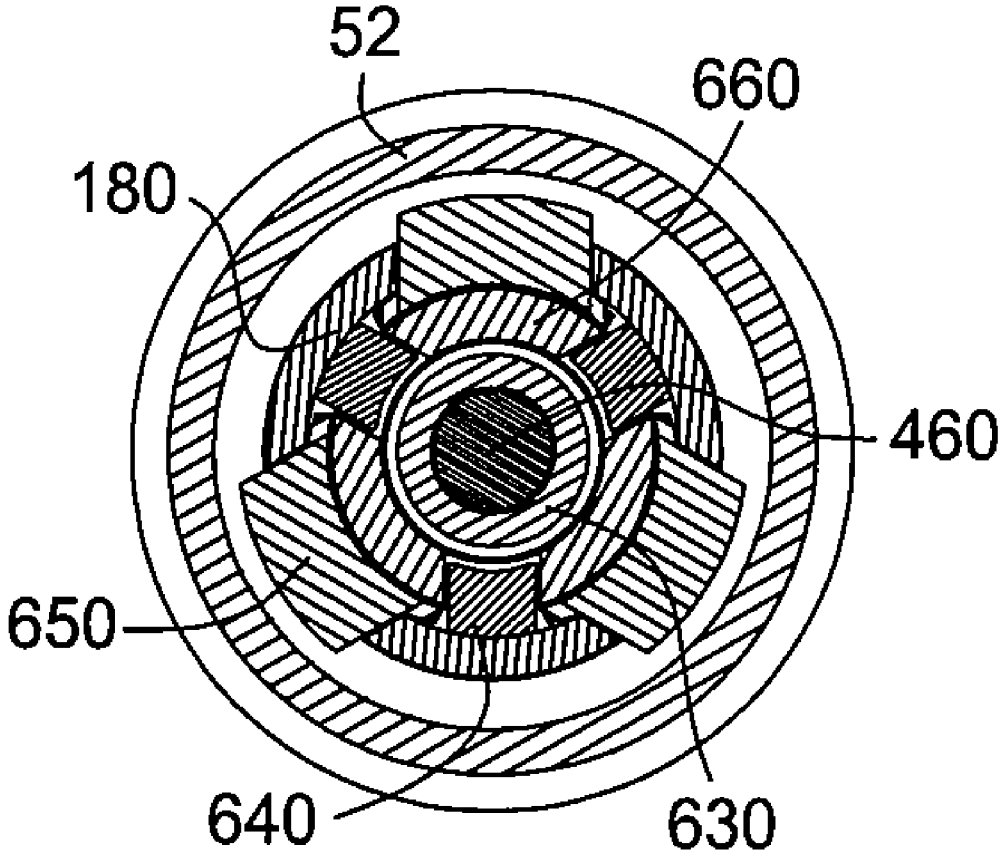
FIGS. 5H presents a cross-sectional view of the tool of FIG. 5A(2), with the view being taken across line H-H. Line H-H is cut through the locking dogs in order to show the locking dogs at the depth of the locating dogs.

In the view of FIG. 5A(2), it can be seen that the locking dogs 640, which ride within the locating mandrel 660, have moved downward to the level of the locating dogs 650. FIG. 5H presents a cross-sectional view of the tool of FIG. 5A(2), with the view being taken across line H-H. Line H-H is cut through the locking dogs 640 in order to show the locking dogs 640 at the depth of the locating dogs 650. The surrounding housing 52 and recess 53 within the valve housing 52 are seen.

To this point, the locking dogs 640 have temporarily locked the locating mandrel 660 to the cutter mandrel 630. However, when the locking dogs 640 reach the depth of the outwardly popped locating dogs 650, the locking dogs 640 are also free to move outwardly, at least to a small extent. In this manner, the locating mandrel 660 is no longer locked to the cutter mandrel 630, and the cutter mandrel 630 is free to move relative to the locating mandrel 660.

Next in FIG. 5A(2), it can be seen that the cutter mandrel 630 has moved downward within the tool 100 relative to the housing system 110. The locking dogs 640 have disengaged from the cutter mandrel 630 to allow this movement. Downward movement of the cutter mandrel 630 transmits downward movement to the cutter mandrel head 670. As noted, the cutter mandrel head 670 has a radial recess 676 disposed about its body. The recess 676 has received shear pins 197 from the surrounding shear pin housing 190. In this manner, the cutter head mandrel 670 is now fixed to the shear pin housing 190 with respect to upward movement.

It should also be noted that downward force applied to the tool 100 through the spang jars has initiated the telescopic shortening of the tool 100. The motor housing 130 and the switch housing 140 have begun to move downward relative to the connected lower housing portions, e.g., hook body housing 160, and button housing 170. It can be seen that the sliding sleeve 155 has received a portion of the switch housing 140. Downward movement of the switch housing 140 has caused a downward force to be applied to the bearing housing 150, which in turn acts downwardly against the setting mandrel 610 and the locating mandrel 660.

Finally, with respect to FIG. 5A(1), it can be seen that the rod 340 has moved upward within the second cavity 148 of the switch 330 housing 140. This has moved the magnet 332 closer to the reed switch 330. However, the reed switch has not yet been magnetically actuated to close the electrical circuit and commence the actuation system 330 to enable the drive system 300.

Moving now to FIGS. 6A(1)-A(2), FIGS. 6A(1)-A(2) present the next step in the cutting process for the milling apparatus 100 of the present invention. FIGS. 6A(1)-A(2) again present a cross sectional view of the milling apparatus 100, as shown from the flask connector 126 downward. It will be seen in this view that the sliding sleeve 155 has continued to receive the switch housing 140, and attached upper components of the tool 100, e.g., motor housing 130 and motor 310. Downward force applied through the motor housing 130 and switch housing 140 has urged the bearing housing 150 downward. This, in turn, has transmitted downward force against the setting mandrel 610 and connected load ring 616. It can be seen now in FIG. 6A(2) that the load ring 616 has contacted the top end of the cones 510. The cones 510 are now in position to urge the buttons 520 outward.

Next from FIG. 6A(2), downward movement of the setting mandrel 610 has transmitted downward movement to the ratchet 620 and the locating mandrel 660. The cutter mandrel 630 can no longer move downward, as the beveled no-go shoulder 636 on the cutter mandrel 630 has shouldered out against the shear pin housing 190. This means that the ratchet 620 can now progress along the outer surface of the cutter mandrel 630.

It can next be seen from FIG. 6A(2) that the cutter body 480 and attached blades 218 and release sleeve 230 have also been moved downward within the safety valve housing 52 and within the tool's housing system 110. The release sleeve 230 can specifically be seen extending further downward through the cutter head housing 210. However, the blades 218 remain locked within the release sleeve 230.

Finally, it can be seen in FIG. 6A(1) that the rod 340 has moved still further upward within the second cavity 148 of the switch housing 140. This, in turn, has moved the magnet 332 closer to the reed switch 330. The magnet 332 is now in sufficient proximity to the reed switch 330 to magnetically close the circuit for the actuation system 300.

Moving now to FIGS. 7A(1)-A(2), FIGS. 7A(1)-A(2) present the next step in the actuation process for the milling tool 100 of the present invention. Telescoping collapse of the housing system 110 is no longer taking place. As noted from FIG. 6A(2), the cutter mandrel head 660 has shouldered out against the shear pin housing 190. Thus, the position of the cutter mandrel head 660 is the same relative to FIG. 6A(2). The position of the release sleeve 230 relative to the cutter head housing 210 is also the same as in FIG. 6A(2).

This is not to say that compressive forces are no longer being applied through the tool. The spang jars continue to transmit downward force through the motor housing 130 and the switch housing 140. This, in turn, transmits force through the bearing housing 150 and against the setting mandrel 610 and connected load ring 616. It can be seen in FIG. 7A(2) that the load ring 616 is now applying force downward against the cones 510 in order to urge them under the buttons 520. This, in turn, forces the buttons 520 outward from the button housing 170 and button housing recess 176.

Also of significance from FIG. 7A(1), the magnet 332 has begun magnetically acting on the reed switch 330. As noted above, a five-minute delay timer is preferably placed into the actuating mechanism 300, in one aspect, as a safety interlocking feature.

FIGS. 8A(1)-A(2) provide a next step for actuating the milling tool 100 of the present invention. In this view, the load ring (darkened at 616), which is disposed about the setting mandrel 610, continues to apply a downward load against the cones 510. It can be seen in FIG. 8A(2) that the buttons 520 have now moved fully outward from the button housing 170 and have engaged the surrounding safety valve housing 52. This serves to prevent torque of the milling apparatus 100 when the drive system 300 is actuated. FIG. 8J is given to show a cross-sectional view of FIG. 8A(2) through the buttons 820. Line J-J is cut through the buttons 520 and demonstrates the outward movement of the buttons 520 into engagement with the surrounding TRSSV housing 50.

It should again be noted that compressive load continues to be applied by the spang jars and downward through the motor housing 130 and the switch housing 140. In FIG. 8A(1), the rod 340 has moved upward further still within the second cavity 146 of the switch housing 140. In addition, it can be seen that the backlash system 800 of the tool 100 is now being invoked. In this respect, the wave washers 802 have been completely compressed against the flat washers 804. In addition, the shear pins 197 within the shear pin housing 190 are positioned at the top of the respective recesses 196 within the shear pin housing 190.

Figure 8I:
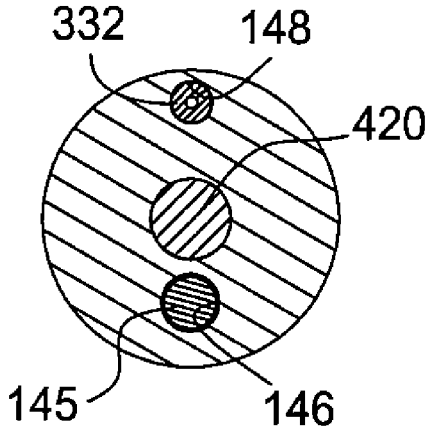
FIG. 8I presents a cross-sectional view of the tool of FIG. 8A(1), with the view being taken across line I-I. This view shows a cross-sectional view of the switch housing. In contrast to the cross-sectional view of FIG. 4C, the magnet and attached rod are now seen in the second cavity.
Figure 8J:
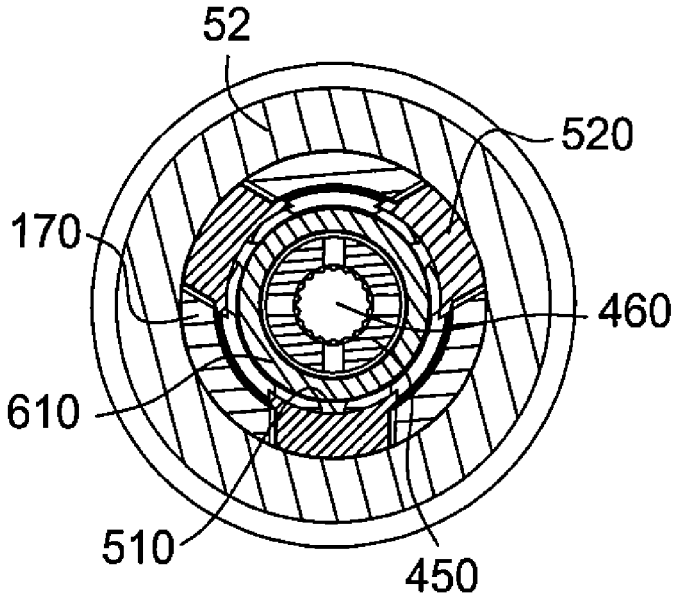
FIG. 8J is given to show another cross-sectional view of FIG. 8A(2). Line J-J is cut through the buttons in order to show outward movement of the buttons towards the surrounding TRSSV housing.

FIG. 8I presents a cross-sectional view of the tool of FIG. 8A(1), with the view being taken across line I-I. FIG. 8I shows a cross-sectional view of the switch housing 140. In contrast to the cross-sectional view of FIG. 4C, the magnet 332 and attached rod 340 are now seen in the second cavity 148 of the switch housing 140.

FIGS. 9A(1)-A(2) present the next chronological step in the actuation process for the milling tool 100 of the present invention. FIGS. 9A(1)-A(2) provide a cross-sectional view of the tool 100, in one embodiment. Again, the tool 100 is only shown from the flask connector 126, downward. In this view, the drive system 300 has been actuated. This means that the motor 310 is now being driven by the batteries (show at 315 in FIG. 3A(1)), and controlled by the controller (shown at 320 in FIG. 3(A)(1)). The motor 310 is providing rotational movement to the shaft system 400 through the gear box 312. The progression of torque transmission is as follows: from the output shaft 410 of the gear box 412, to the drive shaft 420, to the upper drive shaft extension 430, to the lower drive shaft extension 440, to the head cap 450, to the cutting head drive shaft 460, to the spring shaft 470, to the cutter body 480, and to the blades 218.

Rotation of the shaft system 400 also causes the release sleeve 230 to retract along the cutter body 480. This is due to the threaded and splined arrangement described above. In the view of FIG. 9A(2), it can be seen that the release sleeve 230 has traveled upward along the cutter body 480 in order to expose the blades 218. The release sleeve 230 is retracted within the cutter head housing 210 along the keyway 213. This permits the blades 218 to move outward in order to contact the inner surface of the safety valve housing 52. Then, as the cutting system 200 (including blades 218) are rotated, milling takes place.

In the cut-away view of FIG. 9A(2), a pair of blades 218 can be seen. The blades 218 are optionally disposed at an angle to aide in the milling process. Further, the cutting system 200 is optionally placed within the bore of the safety valve 50 in an eccentric manner so as to form an opening in the TRSSV 50 at only one arcuate location (as opposed to a radial cut). The arcuate but non-radial cut is seen more clearly in the subsequent cross sectional view of FIG. 11A(2). In order to accomplish the eccentric cut, a lower recess 56 (seen best in FIG. 11A(2)) is specially pre-formed in the housing 52 of the primary safety valve 50 opposite the portion of the housing to be milled.

The tool 100 on the present invention again includes an optional junk basket feature 700. The junk basket 700 provides a receptacle 702 that catches metal shavings generated during the milling process.

Other aspects of the invention demonstrated within FIGS. 9A(1)-A(2) are worth noting. First, the ratchet 620 continues to engage the cutter mandrel 630. This keeps the buttons 520 energized. However, it can be seen that the wave washers 802 in the backlash system 800 have relaxed a bit. This allows a release of a portion of the jarring load applied through the tool 100, thereby reducing mechanical impact during the jarring process.

Figures 2, 10A:
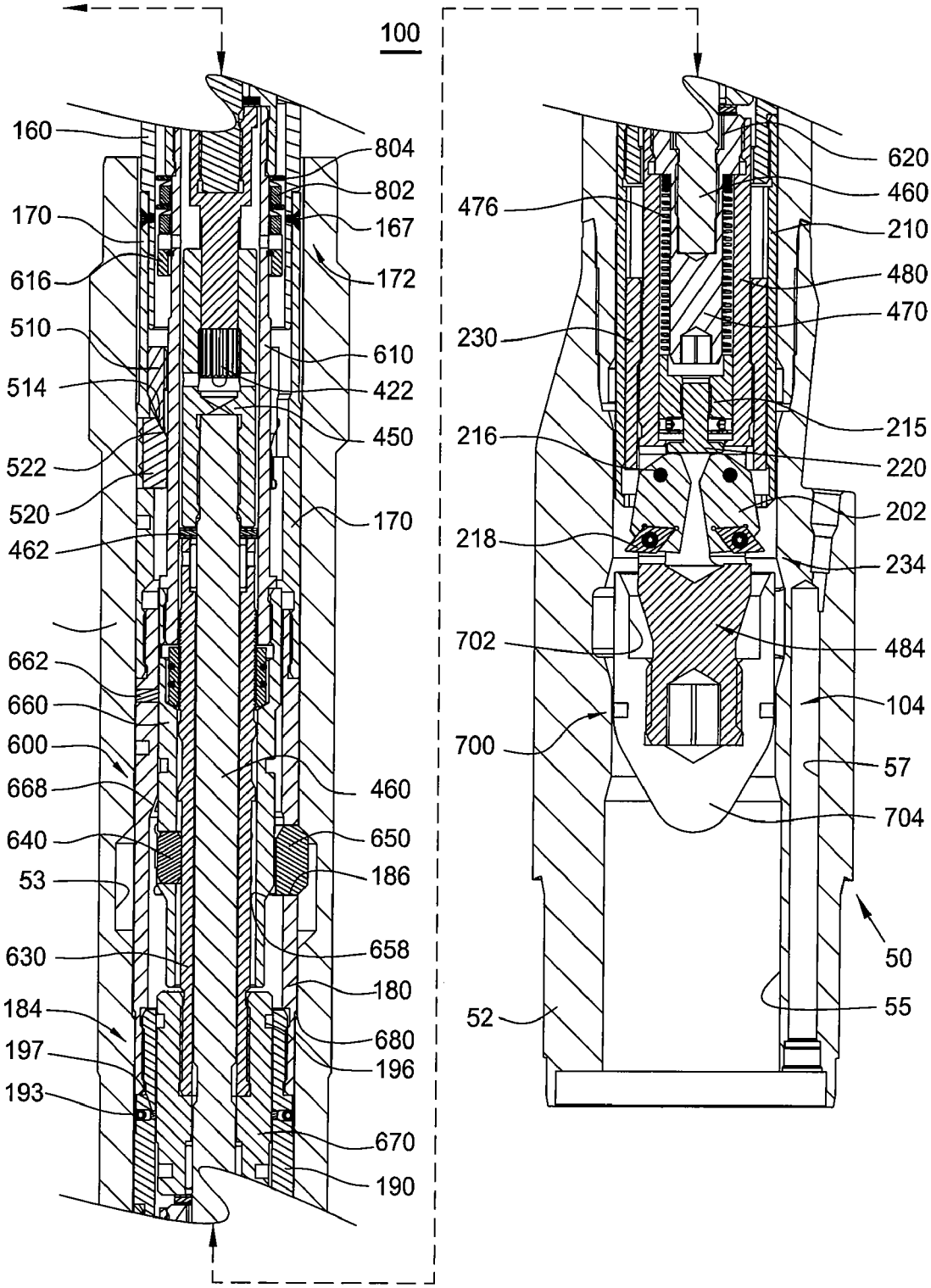
FIGS. 10A(1)-A(2) provide yet another cross-sectional view of the milling tool of FIGS. 4A(1)-A(2). The milling operation is completed, and tensile force is now being applied through the tool housing system in order to withdraw the milling tool from the wellbore. The cones are being lifted, causing the buttons to recede from the surrounding valve housing. In addition, the cutter head and attached blades are being pulled into the cutter head housing.

Moving now to FIGS. 10A(1)-A(2), FIGS. 10A(1)-A(2) present a new cross-sectional view of the milling tool 100 of the present invention. The cross-sectional view of FIGS. 10A(1)-A(2) show the milling tool 100 within the TRSSV 50 after the milling process has been completed. Compressive force is no longer being applied through the tool 100, and the tool 100 is beginning to be pulled from the wellbore. It can be seen in FIG. 10A(1) that the motor housing 130 and connected switch housing 140 are being pulled back from the sliding sleeve 155. The connected bearing housing 150 is no longer applying a downward force against the setting mandrel 610 and the radially disposed load ring 616. It can further be seen in FIG. 10A(2) that the load ring 616 is no longer engaging the cones 610. Indeed, the cones have slipped back from the buttons 520, allowing the buttons 520 to recede back within the button housing 170.

Pulling up on the tool 100 causes a series of tension forces to be applied through the tool 100. The forces are as follows: from the thermal housing 120, to the motor housing 130, to the switch housing 140, to the bearing housing 150, to the setting mandrel 610, to the locating mandrel 660, to the cutter mandrel 630 through the ratchets 620, to the cutter mandrel head 670, to the cutter mandrel head shear pins 197. Continued upward force will ultimately shear the shear pins 197. In addition, continued upward force will pull the cutter body 480 and attached blades 218 and junk basket 700.

Finally, FIGS. 11A(1)-A(2) present a cross-sectional view of the milling apparatus 100 of FIG. 10, being further removed from the tubing-retrievable subsurface safety valve 50. The shear pins 197 connecting the shear pin housing 190 to the cutter mandrel head 670 have been sheared. Also, the magnet 332 is pulled away from the reed switch 330, telling the controller 320 to turn off the motor 310. The blades 218 are retracted completely under the cutting head housing 210 to present scratching of the tubing during pull out. In addition, the locating dogs 650 have been retracted, and will catch the shoulder in the cutter mandrel 630 on the way out of the hole, thereby pulling all connected parts.

Of most importance in the view of FIG. 11A(2), one can see the opening 58 formed from the milling process. A clear opening 58 is shown through the housing 52 of the TRSSV 50 opposite the lower recess 56. This provides a path of fluid communication from a hydraulic fluid pressure line (not shown) and the hydraulic chamber 57 of the safety valve 50 into the inner bore 55 of the valve 50. In the view of FIG. 11A(2), an eccentric cut has been made, meaning that milling has been conducted on only one arcuate portion of the inner wall of the safety valve 50. This unique and novel feature makes the milling process more efficient and precise.

In order to conduct the milling operation of the present invention, a milling tool 100 is disposed at the end of a working string. The working string may be a slickline (including a wireline) or a string of coiled tubing or other string. The milling tool 100 is lowered into the production tubing of a well until it reaches the depth of a tubing-retrievable subsurface safety valve. The milling tool 100 is landed within the TRSSV, and is preferably landed on a shoulder within the bore of the valve for precise locating.

After landing, downward force is transmitted through the tool 100. Jarring down will shear the pins 662 to start the locking process. The locating mandrel 660 will shift down to push the locating logs 650 outward. If the locking dogs 640 are not located properly in the valve 50, the locating dogs 650 will constrain further action of the locking dogs 640 and will prevent the locking dogs 640 from setting. If the tool 100 is properly landed, then the locking dogs 640 will move outward into the profile 56 of the valve 50, or "landing nipple," and over the OD of the locating mandrel 660, thereby permitting further action of the locking dogs 640.

As the locating mandrel 660 continues to move downward, the setting mandrel 610 OD will move out from underneath the cones 510, permitting their inward and downward movement until they contact the smaller OD of the setting mandrel 630. Further downward motion of the locating mandrel 660 causes the load ring 616 to contact the cones 510. The resulting downward motion of the cones 510 causes the buttons 520 to move radially outward and contact the ID of the safety valve 50. The cones 510 are constrained from moving radially outward by the ID of the button housing 170.

Further jarring down will compress the wave washers 802 to increase the load on the cones 510 and buttons 520. At maximum load, the locating mandrel 660 will bottom against the cutter mandrel head 670. Excessive jarring loads are taken up through the cutter head housing 210, the shear pin housing 190, the no-go body housing 180, and ultimately into the no-go shoulder of the valve housing 52, and do not transmit into the buttons 520. The wave washers 802 take up any backlash in the locking process (caused by ratchet motion, shear pin clearances, etc.) and maintain the maximum force on the buttons 520.

The jarring process also serves to initiate the actuation system 300. In this respect, after the milling tool 100 has been deployed in the TRSSV, the actuation system of the milling tool 100 is initiated. In one arrangement, actuation is begun by mechanically jarring down on the tool 100, causing the housing system 110 to telescopically compress. This, in turn, brings a magnetic force into sufficient proximity with a reed switch 330 in order to close an electrical circuit. Closure of the electrical circuit sends an enable signal from the reed switch 330 to initiate the startup sequence in the controller. After a specified delay, (e.g., 5-minutes by default), the controller 320 will ramp the motor 310 of the drive system 300 up to full speed, and maintain motor speed throughout the entire cut. The milling operation for the inner bore 55 of the primary valve 50 is then conducted.

The wave washer stack 802 applies force to the choke box 215 and choke pin 220. Together, the choke box 215 and choke pin 220 act as a cam follower to transmit the load of the wave washers 802 to the cam lobes 202 of the knives 218. A nearly constant knife tip load is maintained by the cam design.

During operation, the knives 218 will remove material from the chamber housing 52 of the valve 50. The resulting shavings are collected in the junk basket 702. The knives 218 will continue to remove material until communication has been established between the chamber housing ID and the chamber 57, at which time the knives 218 will reach their travel limit. Knife travel is limited by a shoulder that stops downward movement of the choke box 215 in the cutter body 480. The diametrical height of the knives 218 at this limit is set by the location of the choke pin 220 within the choke box 215.

The cutting process may take up to 15 or 20 minutes. When the reasonable time for milling has expired, hydraulic pressure may be applied into the hydraulic fluid line (not shown) into the TRSSV. A sudden drop in pressure indicates a successful communication. The motor 310 is optionally permitted to run until power is no longer supplied by the batteries 315. Continued milling will open the hole further and clean the cut. The batteries 315 should be completely depleted within an hour.

After completion of the cut, the cutter body 480 is pulled inside the cutter head housing 210 to retract the knives 218. The knives 218 spring out inside of a recess in the cutter head housing 210 and prevent the cutter body 480 from dropping back out for any reason. This is to ensure that the knives 218 stay retracted while pulling out of the hole. In addition, while pulling out, the junk basket 700 closes against the cutter head housing 210 to retain the metal chips that were trapped during the cut.

Pulling out of the hole will involve some upward jarring. Upward jarring is transmitted from the locating mandrel 660 to the cutter mandrel 630 through the ratchets 620, thereby shearing the steel shear pins 197 that lock the cutter mandrel head 670 into the shear pin housing 190.

Upward motion causes the larger OD of the setting mandrel 610 to strike the cones 510, moving them upward. This pulls the buttons 520 off of the valve's bore 55. At this point, the cutter mandrel 630, ratchet 620, and the entire locating system 600 moves upward until the locating dogs 650 strike the recess 56 of the valve housing 52. The cutting system 200 is then pulled into the cutting head housing 210, retracting the knives 218.

Still further upward motion pulls the locating mandrel 660 OD from under the locating dogs 650, thereby allowing the dogs 650 to retract. This frees the tool 100 from the primary valve 50 in the production tubing. Of course, upward jarring also causes the housing system 110 to telescope back out, moving the magnet 332 away from the switch 330. The circuit for the drive system 300 is thus opened. The controller 320 will immediately begin a shutdown sequence.

The present invention, therefore, is well adapted to carry out the above described objects and realize the advantages mentioned. Certain embodiments have been given for the purpose of disclosure, but variations to the details of construction, arrangement of parts and steps of the method may be afforded, and alternate uses of the present invention may be conceived without divergence from the scope and spirit of the present invention as described in the appended claims.

We claim:

1. A method for forming an opening in the housing of a tubing-retrievable subsurface safety valve, the safety valve comprising a pressure containing body having an inner surface and a bore therethrough, the method comprising:

running a milling tool into a wellbore, the wellbore having a string of production tubing therein, and the production tubing having the tubing-retrievable subsurface safety valve in series therein, the milling tool comprising:

an elongated housing system, at least a portion of the housing system being dimensioned to be received within the bore of the pressure containing body of the tubing-retrievable subsurface safety valve;

a cutting system having at least one blade;

a drive system configured to rotate the at least one blade in the cutting system, the drive assembly residing within the housing system; and an actuating system for actuating the drive assembly, the actuating system also residing within the housing system;

landing the milling tool into the bore of the pressure containing body of the tubing-retrievable subsurface safety valve;

initiating the actuating system so as to actuate the drive system and cause the at least one blade to rotate, thereby forming an opening in the pressure containing body; and removing the milling tool from the wellbore.

2. The method for forming an opening in the housing of a tubing-retrievable subsurface safety valve of claim 1, wherein the housing system comprises a plurality of sub-housings.

3. The method for forming an opening in the housing of a tubing-retrievable subsurface safety valve of claim 1, wherein the drive assembly includes a rotary motor and a drive shaft connected to the cutting system.

4. A method for forming an opening in the housing of a tubing-retrievable subsurface safety valve, the safety valve comprising a pressure containing body having an inner surface and a bore therethrough, the method comprising:

running a milling tool into a wellbore, the wellbore having a string of production tubing therein, and the production tubing having the tubing-retrievable subsurface safety valve in series therein, the milling tool comprising:

an elongated housing system, at least a portion of the housing system being dimensioned to be received within the bore of the pressure containing body of the tubing-retrievable subsurface safety valve, wherein the housing system comprises a plurality of sub-housings;

a cutting system;

a drive system for driving the cutting system, the drive assembly residing within the housing system, wherein the drive system comprises: a rotary motor; and a drive shaft system having a first end and a second end, the first end being mechanically coupled to the rotary motor, and the second end being connected to the cutting system; and an actuating system for actuating the drive assembly, the actuating system also residing within the housing system;

landing the milling tool into the bore of the pressure containing body of the tubing-retrievable subsurface safety valve;

initiating the actuating system so as to actuate the drive system and to drive the cutting system, thereby forming an opening in the pressure containing body; and removing the milling tool from the wellbore.

5. The method for forming an opening in the housing of a tubing-retrievable subsurface safety valve of claim 4, wherein the cutting system comprises at least one blade for shaving the inner surface of the pressure containing body of the tubing-retrievable subsurface safety valve until an opening has been formed in the pressure containing body.

6. The method for forming an opening in the housing of a tubing-retrievable subsurface safety valve of claim 5, wherein the blade is rotated by the drive shaft system.

7. The method for forming an opening in the housing of a tubing-retrievable subsurface safety valve of claim 6, wherein the at least one blade is configured to form an eccentric opening within the pressure containing body of the tubing-retrievable subsurface safety valve.

8. The method for forming an opening in the housing of a tubing-retrievable subsurface safety valve of claim 7, wherein each blade is disposed on a cutter member having a cam lobe at an upper end.

9. The method for forming an opening in the housing of a tubing-retrievable subsurface safety valve of claim 8, wherein the cutting system further comprises: a cutter body coupled to the second end of the shaft system; a choke box; a pin disposed within the choke box, and having a surface for contacting the cam lobes of the respective cutter members; and a hinge connecting the respective cutter members to the cutter body, the cutter members pivoting about the hinges when the pin acts against the cam lobes, causing the blades to rotate outward towards the surrounding pressure containing body of the tubing-retrievable subsurface safety valve.

10. The method for forming an opening in the housing of a tubing-retrievable subsurface safety valve of claim 6, wherein: the actuating system comprises a magnet, and a switch sensitive to the magnet; and the housing system is configured such that the magnet and the switch are moved into proximity with one another after the housing system is landed into the bore of the pressure containing body of the tubing-retrievable subsurface safety valve.

11. The method for forming an opening in the housing of a tubing-retrievable subsurface safety valve of claim 10, wherein: the rotary motor is a DC motor; the drive system further comprises one or more batteries for powering the motor; and the drive system also further comprises a controller for controlling the motor.

12. The method for forming an opening in the housing of a tubing-retrievable subsurface safety valve of claim 11, wherein: the switch is a reed switch responsive to a magnetic force; and the reed switch provides electrical communication between the batteries, the controller and the motor in response to the magnetic force provided by the magnet when the magnet and the reed switch are brought into sufficient proximity with one another.

13. The method for forming an opening in the housing of a tubing-retrievable subsurface safety valve of claim 12, wherein the step of initiating the actuating system is performed by applying downward pressure to the milling tool in order bring the switch and the reed magnet into sufficient proximity with one another.

14. The method for forming an opening in the housing of a tubing-retrievable subsurface safety valve of claim 6, wherein the plurality of subhousings of the housing system comprises: a motor housing for housing the motor; a switch housing having a central bore for receiving a portion of the drive shaft system, and a second cavity for housing the reed switch; and a cutter head housing for housing the cutting system.

15. The method for forming an opening in the housing of a tubing-retrievable subsurface safety valve of claim 14, wherein the switch housing further comprises a first cavity for housing a pressure balancing piston, the first cavity having a dielectric fluid above the piston, and being exposed to wellbore pressure below the piston.

16. The method for forming an opening in the housing of a tubing-retrievable subsurface safety valve of claim 15, wherein the plurality of subhousings of the housing system further comprises a sliding sleeve, the sliding sleeve receiving a portion of the switch housing as the milling tool is landed into the bore of the pressure containing body of the tubing-retrievable subsurface safety valve, in order to telescopically reduce the length of the housing system.

17. The method for forming an opening in the housing of a tubing-retrievable subsurface safety valve of claim 16, wherein the plurality of subhousings of the housing system further comprises: a thermal housing for housing the one or more batteries and the controller; and a flask connector for connecting the thermal housing and the motor housing.

18. The method for forming an opening in the housing of a tubing-retrievable subsurface safety valve of claim 17, wherein the actuating system further comprises an electrical connector for placing the motor and the batteries in electrical communication, the electrical connector being housed in the flask connector.

19. A method of forming an opening in a tubular body within a wellbore, comprising:

running a tool into the wellbore, the tool comprising:

a mechanical cutting system;

a positioning member; and an actuating system for actuating the mechanical cutting system, wherein the actuating system includes a magnet and a switch sensitive to the magnet, positioning the tool in the tubular body at a predetermined location by mating the positioning member with a profile formed in the tubular body;

activating the mechanical cutting system by operating the actuating system, wherein the magnet and the switch move into proximity with one another when the tool is positioned at the predetermined location which causes the actuating system to operate; and forming the opening in the tubular body.

20. The method of claim 19, further including lowering the tool into the wellbore on coiled tubing.

* * * * *